US010815697B1

(12) United States Patent
Weinerman et al.

(10) Patent No.: US 10,815,697 B1
(45) Date of Patent: Oct. 27, 2020

(54) LATCH APPARATUS

(71) Applicant: The Eastern Company, Cleveland, OH (US)

(72) Inventors: Lee S. Weinerman, Medina, OH (US); Scott Arthurs, Brunswick, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 157 days.

(21) Appl. No.: 16/167,941

(22) Filed: Oct. 23, 2018

Related U.S. Application Data

(60) Provisional application No. 62/579,477, filed on Oct. 31, 2017.

(51) Int. Cl.

| | |
|---|---|
| ***E05B 47/06*** | (2006.01) |
| ***E05C 3/16*** | (2006.01) |
| ***E05B 47/00*** | (2006.01) |
| ***E05B 9/04*** | (2006.01) |

(52) U.S. Cl.
CPC ..... *E05B 47/0676* (2013.01); *E05B 9/04* (2013.01); *E05B 47/0012* (2013.01); *E05C 3/16* (2013.01); *E05B 2047/0021* (2013.01); *E05B 2047/0084* (2013.01)

(58) Field of Classification Search
CPC .... E05B 47/0676; E05B 9/04; E05B 47/0012; E05B 2047/0021; E05B 2047/0084; E05B 47/0688; E05B 47/0692; E05B 2047/002; E05C 3/16; E05C 3/165; E05C 3/24; E05C 3/26; E05C 3/40
USPC ..... 70/278.7, 279.1; 292/199, 201, 216
See application file for complete search history.

(56) References Cited

U.S. PATENT DOCUMENTS

| | | | | | |
|---|---|---|---|---|---|
| 3,504,511 | A * | 4/1970 | Allen | E05B 83/16 | 70/241 |
| 4,268,076 | A * | 5/1981 | Itoi | E05B 65/461 | 292/201 |
| 4,685,709 | A * | 8/1987 | Kambic | E05B 47/0012 | 292/201 |
| 5,058,258 | A * | 10/1991 | Harvey | E05B 47/0607 | 29/401.1 |
| 5,148,691 | A * | 9/1992 | Wallden | E05B 47/0012 | 70/279.1 |
| 5,667,260 | A * | 9/1997 | Weyerstall | E05B 13/005 | 292/201 |
| 5,676,003 | A * | 10/1997 | Ursel | E05B 77/26 | 292/201 |
| 5,715,713 | A * | 2/1998 | Aubry | E05B 81/06 | 292/201 |
| 5,884,948 | A * | 3/1999 | Weinerman | E05B 5/00 | 292/216 |

(Continued)

*Primary Examiner* — Lloyd A Gall
(74) *Attorney, Agent, or Firm* — Ralph E. Jocke; Colin P. Cochran; Walker & Jocke

(57) ABSTRACT

A latch (202) includes a catch jaw (210) which is operative to releasably engage a post. A release pawl (212) is operative to hold the catch jaw in a latched jaw position, and upon movement of the release pawl, enables the catch jaw to move to an unlatched jaw position. In an unlocked condition of the latch, movement of a handle (206) is operative to enable the latch to change from the latched to unlatched condition. The latch includes a keylock (240) and an electrical actuator (308). Each of the keylock and the electrical actuator are operative to independently change the condition of the latch between locked and unlocked conditions.

23 Claims, 22 Drawing Sheets

(56) References Cited

U.S. PATENT DOCUMENTS

| | | | | |
|---|---|---|---|---|
| 6,513,353 | B1 * | 2/2003 | Weinerman | E05B 5/00 292/48 |
| 8,146,394 | B2 * | 4/2012 | Krueger | E05B 5/00 292/DIG. 31 |
| 8,347,667 | B2 * | 1/2013 | Bacon | E05B 5/00 292/216 |
| 8,393,187 | B2 * | 3/2013 | Bacon | E05B 5/00 292/201 |
| 8,733,139 | B2 * | 5/2014 | Pickar | E05B 81/25 292/336.3 |
| 9,238,925 | B2 * | 1/2016 | Weinerman | E05B 63/00 |
| 9,399,879 | B2 * | 7/2016 | Burns | E05B 85/18 |
| 9,611,678 | B2 * | 4/2017 | Weinerman | E05C 3/24 |

* cited by examiner

LATCH APPARATUS

TECHNICAL FIELD

Exemplary embodiments relate to a latch apparatus used to selectively engage and release a member.

BACKGROUND

A latch apparatus may be used to selectively engage and release a member such as a striker which is alternatively referred to herein as a post, that is attached to a door or other closure member. A latch apparatus may be configured to be selectively unlatched through movement of a manually movable handle. The condition of a latch apparatus may be secured through use of a locking device. The locking device may be changed between locked and unlocked conditions. For example, in an unlocked condition, the latch may be disengaged from the striker responsive to movement of the handle. However, in a locked condition the latch will not disengage the striker even when the handle is moved in a manner that causes the latch to disengage when the lock is in an unlocked condition. Various configurations of latches may be utilized for different types of strikers or other members. Latches may be used with various types of locks including for example, key locks, combination locks, motorized locks or other types of locks which may be selectively placed in a locked and an unlocked condition.

Latch apparatus may benefit from improvements.

DETAILED DESCRIPTION

Figure 1:
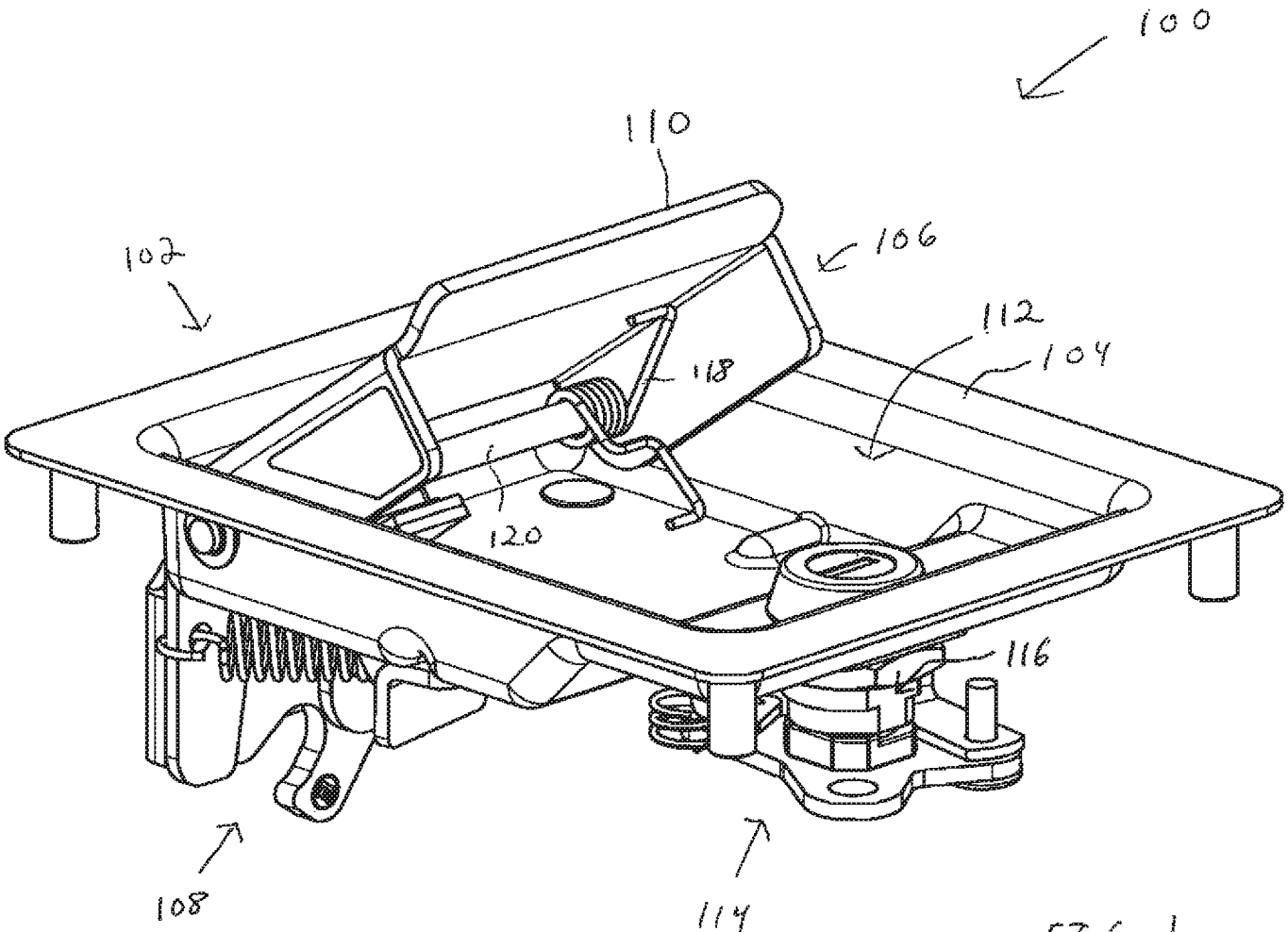
FIG. 1 is a front, bottom, left side perspective view of an example latch assembly.

Various arrangements pertaining to latch assemblies will now be described with reference to the drawings, where like reference numerals represent like elements throughout. Also, it is to be understood that functionality that is described as being carried out by certain components may be performed by multiple components. Similarly, multiple components that may be configured to perform the functionality that is described may have the functionality carried out by a single component. The disclosures of U.S. Pat. Nos. 9,611,678; 9,238,925; and 6,513,353 are each incorporated herein by reference in their entirety.

With reference to FIG. 1, an example embodiment 100 of a latch assembly 102 is illustrated. The latch assembly includes a housing 104 to which is mounted a release mechanism 106 and a latch mechanism 108. The release mechanism 106 includes a pivoting handle 110 on a front side of the housing. The latch mechanism 108 is mounted on the rear side of the housing. Operation of the release mechanism is operative to cause the latch mechanism to operate. In this example the latch assembly 102 corresponds to a paddle handle latch. However, it should be noted that the features described herein for the latch assembly 102 may be used on other types of latch assemblies that include release mechanisms with user operated handles.

In an example embodiment, the housing 104 includes a receptacle 112. The handle 110 is operative to pivot between a retracted position and an extended position (shown in FIG. 1) relative to the receptacle. In the extended position, the handle extends relatively farther out of the receptacle than when in the retracted position.

Figure 5:
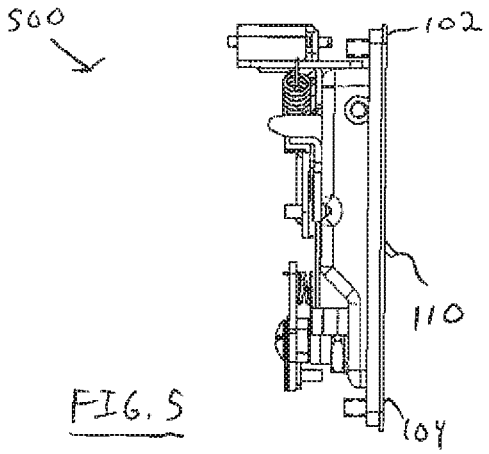
FIGS. 5-7 show side views of the latch assembly with the handle in different positions.
Figure 2:
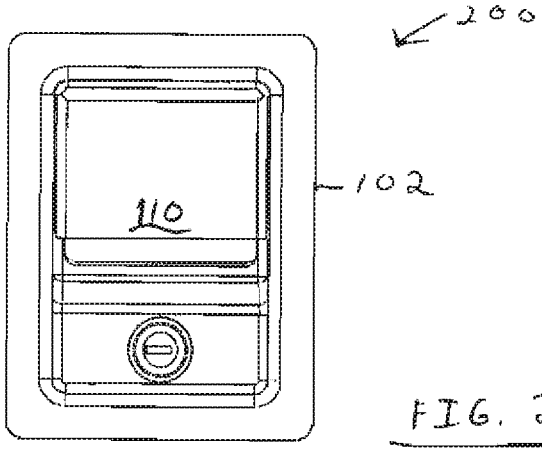
FIGS. 2-4 show front views of the latch assembly with a handle in different positions.
Figure 6:
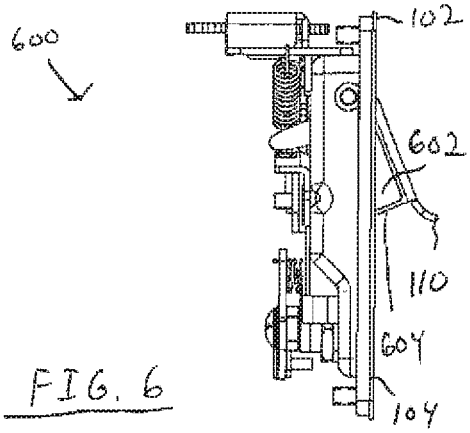
Figure 3:
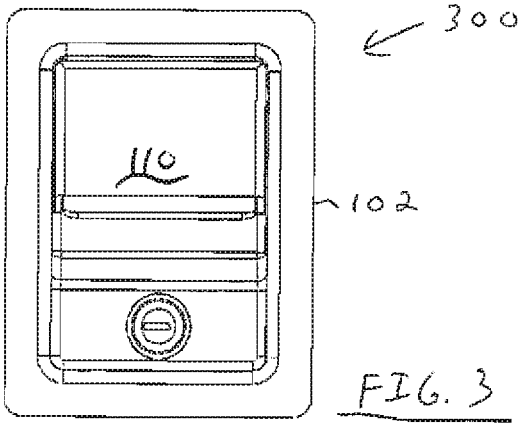
Figure 7:
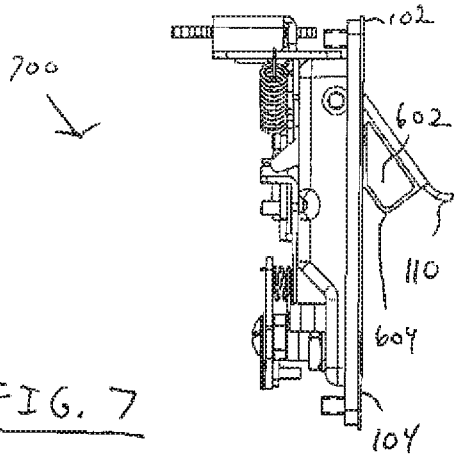
Figure 4:
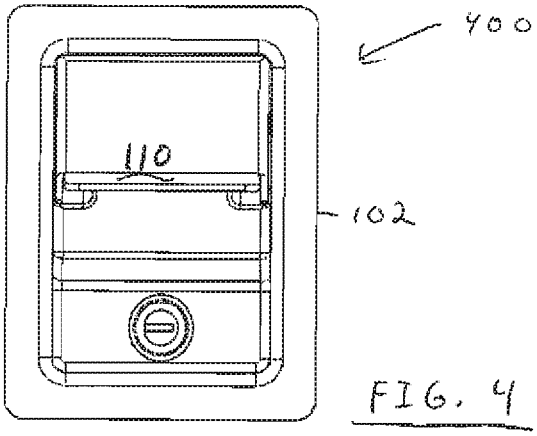

To further illustrate the operation of the handle, FIGS. 2, 3, and 4 show front views 200, 300, 400 of the latch assembly 102 with the handle 110 respectively shown in retracted, intermediate, and extended positions. Here the intermediate position of the handle corresponds to a partially extended orientation of the handle between the retracted and extended positions. Also, FIGS. 5, 6, and 7, show corresponding side views 500, 600, 700 of the latch assembly 102 with the handle respectively shown in the retracted, intermediate, and extended positions.

In an example embodiment, the latch mechanism may be operable to change between a latched condition and an unlatched condition responsive to the handle being moved from the retracted position toward the extended position. For example, starting from the latched condition, the latch mechanism 102 will have the configuration shown in FIGS. 2 and 5 with the handle 110 in a retracted position. To unlatch the latch mechanism, a user may pull on the handle which moves the handle 110 through the intermediate position shown in FIGS. 3 and 6 to an extended position shown in FIGS. 4 and 7. Then upon the user letting go of the handle 110, the latch mechanism is operative to automatically move the handle back to the intermediate position shown in FIGS. 3 and 6, where the handle is operative to remain until the latch mechanism is again placed in a latched condition. As will be explained in more detail below, in the exemplary arrangement the visual appearance of the handle in the intermediate position or an extended position serves as a visual indication that the handle is not in a latched condition.

Also, it should also be appreciated that in some embodiments, the described latch assembly may include a lock mechanism 114 that is configured to change between a locked condition and an unlocked condition. In the unlocked condition, the lock mechanism may be operative to permit movement of the handle 110 toward the extended position to cause the latch to change from a latched to an unlatched condition. However, when the lock mechanism is in the locked configuration, movement of handle to the extended position will not cause the latch mechanism to change to an unlatched configuration.

In the example shown in FIG. 1, the exemplary lock mechanism 114 includes a lock that includes a rotatable cylinder 116 that is operative to receive a key. Rotation of the key and the lock cylinder is operative to cause the lock to change between its locked and unlocked conditions. However, it should be appreciated that alternative embodiments may include different types of lock mechanisms mounted to the housing 104 and/or off of the housing (and connected via linkages/rods to the latch assembly). Also, it should be appreciated that in alternative embodiments, the latch assembly may not include or be connected to a lock mechanism. Also, it should be appreciated that in alternative arrangements of the example embodiments described herein, additional release mechanisms may be connected to the latch assembly via one or more linkages/rods in a manner that enables the additional release mechanisms to control the operation of the lock mechanism and/or the latch mechanism.

As shown in FIG. 1, example embodiments of the latch assembly 102 may include a spring 118 that is positioned to urge the handle 110 to move from the retracted position toward the extended position. Such a spring may correspond to a coil spring mounted around a shaft 120 about which the handle 110 is configured to pivot. Such a shaft may extend across the width of the receptacle and extend through apertures in the housing on opposed sides of the handle 110. However, it should be appreciated that in alternative embodiments the handle may be mounted in pivoting relation with the housing 104 in a manner that does not include a shaft extending across the receptacle 112 or in other configurations. In such alternative embodiments, one or more springs may be mounted to the housing and/or handle in a different configuration via one or more fasteners so as to be operative to urge the handle to move from the retracted position toward the extended position.

Figure 8:
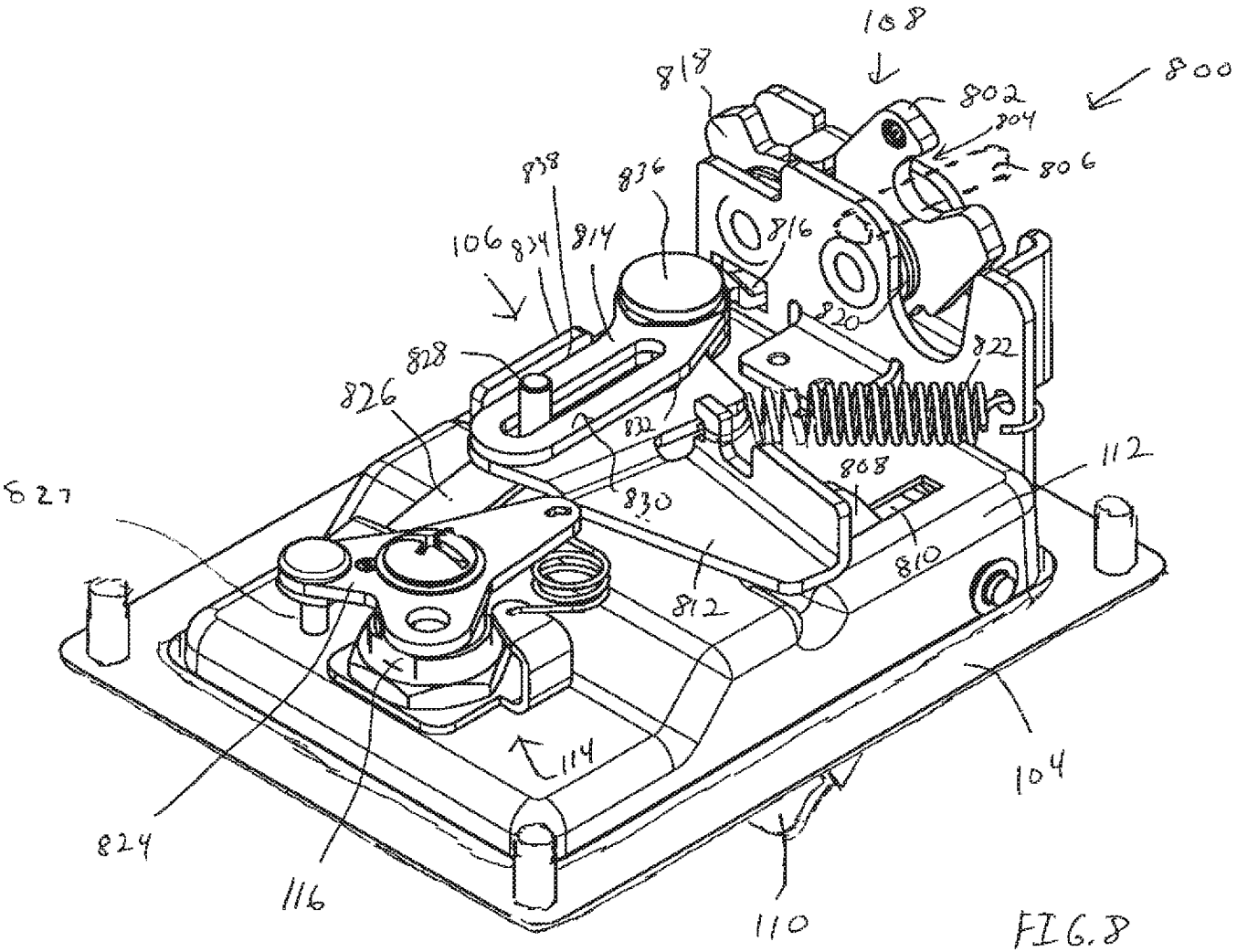
FIG. 8 is a rear, bottom, left side perspective view of the example latch assembly.

FIG. 8 is a perspective view 800 of a rear side of the housing 104. FIG. 8 and FIG. 1 show the latch assembly with the latch mechanism 108 in the unlatched configuration and with the release mechanism 106 in a release configuration. FIG. 1 shows the handle 110 in the extended position. Also, FIG. 8 and FIG. 1 show the lock mechanism 114 in an unlocked state.

In this described example embodiment, the latch mechanism 108 includes a latch member which is alternatively referred to as a rotary latch 802. Such a rotary latch 802 is operative to rotate clockwise and downwardly as shown in FIG. 8 to a latched positioned that is operative to hold a post or striker 806 (schematically shown in broken lines) in a channel, such as a "U" shaped notch 804 extending in a pair of disposed wall/plates 1002 of the rotary latch 802.

The described latch assembly may be configured such that when a lower portion of the handle 110 is manually lifted/pivoted (by a user) to the extended position, a trigger 808 connected to the handle 110 is operative to move in a manner that causes the latch mechanism 108 to unlatch an engaged striker 806. In the exemplary embodiment the trigger movement causes the rotary latch 802 to rotate counter-clockwise and upwardly to the position shown in FIG. 8.

The exemplary trigger extends through an aperture 810 through a wall of the receptacle 112 of the housing 104. The trigger operatively extends from the handle positioned on a front side of the housing and is engageable with further portions of the release mechanism 106 positioned on the rear side of the housing.

Figure 8A:
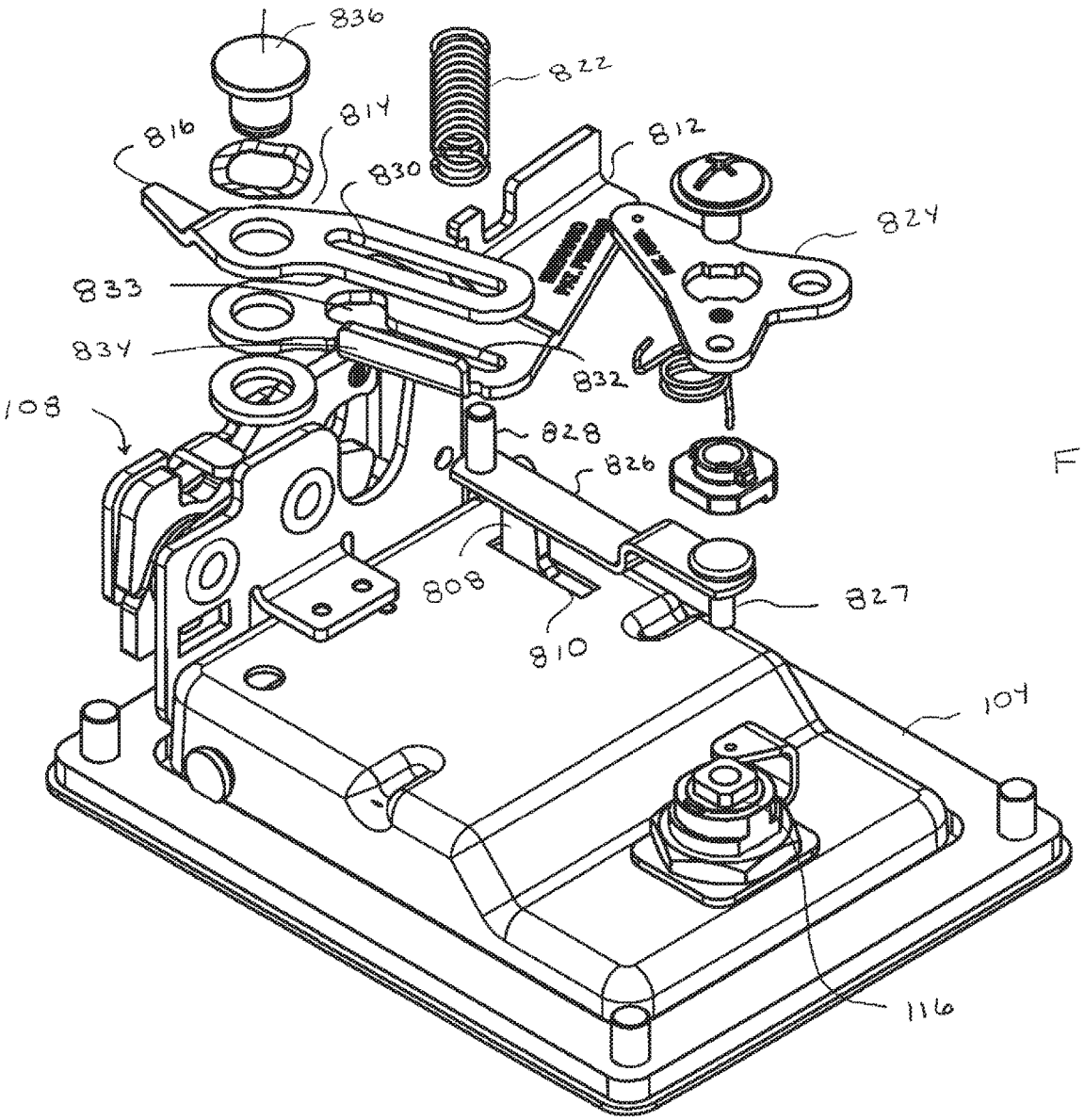
FIG. 8A is an exploded view corresponding to the main components shown in FIG. 8.

The further portions of the exemplary release mechanism 106 may include at least one linkage or lever in pivoting operatively supporting connection with the housing. For example, in this exemplary embodiment, the further portions of the release mechanism 106 include a first member, lever or linkage referred to herein as a disconnect lever 812, and a second member, lever or linkage 814 referred to herein as an actuation or actuator lever 814. In the exemplary arrangement these levers are in relative pivoting connection with the housing about a common pivot location 836. Positioned at such a pivot location 836 may be a shoulder rivet, bolt or shaft that extends through apertures in these levers and into operative engagement with the housing. As shown in FIG. 8A, suitable washers are positioned to facilitate rotation of the disconnect lever 812 and the actuator lever 814 about the common axis that extends through the fastener at the pivot location 836.

In the exemplary embodiment when the lock mechanism 104 is in an unlocked condition, the pivoting of the handle (from the retracted to the extended position) is operative to cause the trigger 808 to move downwardly on the back side of the housing. The trigger engages and causes the disconnect lever 812 to move/pivot in a direction that causes the actuator lever 814 to move/pivot in a direction that causes the latch mechanism 108 to change to its unlatched condition.

In this example, the exemplary actuation lever 814 includes a projection 816 that extends adjacent portions of the latch mechanism 108 such as a rotary pawl 818. As the actuation lever pivots (responsive to the handle), the projection 816 is positioned to urge the rotary pawl to move/rotate to a position that permits the rotary latch 802 to rotate so as to disengage an engaged striker. A spring 820 included in the latch mechanism 108 urges the rotary latch 802 to rotate to the unlatched configuration position shown in FIG. 8.

Also, as shown in FIG. 8, the exemplary release mechanism also includes a spring 822. This spring is operative to bias the disconnect lever 812 towards the trigger 808. Such an arrangement may operatively urge the trigger to move the handle toward its retracted position. However, in this exemplary embodiment, when the release mechanism is in the unlatched position shown in FIG. 8, the rotary pawl 818 is operative to prevent the spring 822 from causing the disconnect lever 812 from moving back to its initial position from the actuating position in which it changes the condition of the latch. The inability of the disconnect lever to return to the initial position prevents the trigger and the attached handle from moving all the way to the retracted position of the handle. Rather, the exemplary configuration of the exemplary rotary pawl 818 is operative when the latch is in the unlatched configuration, to limit the movement of the handle 110 in response to spring 822 to only the intermediate position shown in FIGS. 6 and 3. Also, it should be appreciated that in this exemplary arrangement, the spring 118 associated with the handle (shown in FIG. 1) also urges the handle 110 to remain at the intermediate position so that it does not pivot back to the retracted position due to gravitational forces. It should be understood that while in the exemplary embodiment the handle is biased to an intermediate position, in alternative embodiments the handle may be biased to other positions, including without limitation, to the extended position.

Figure 9:
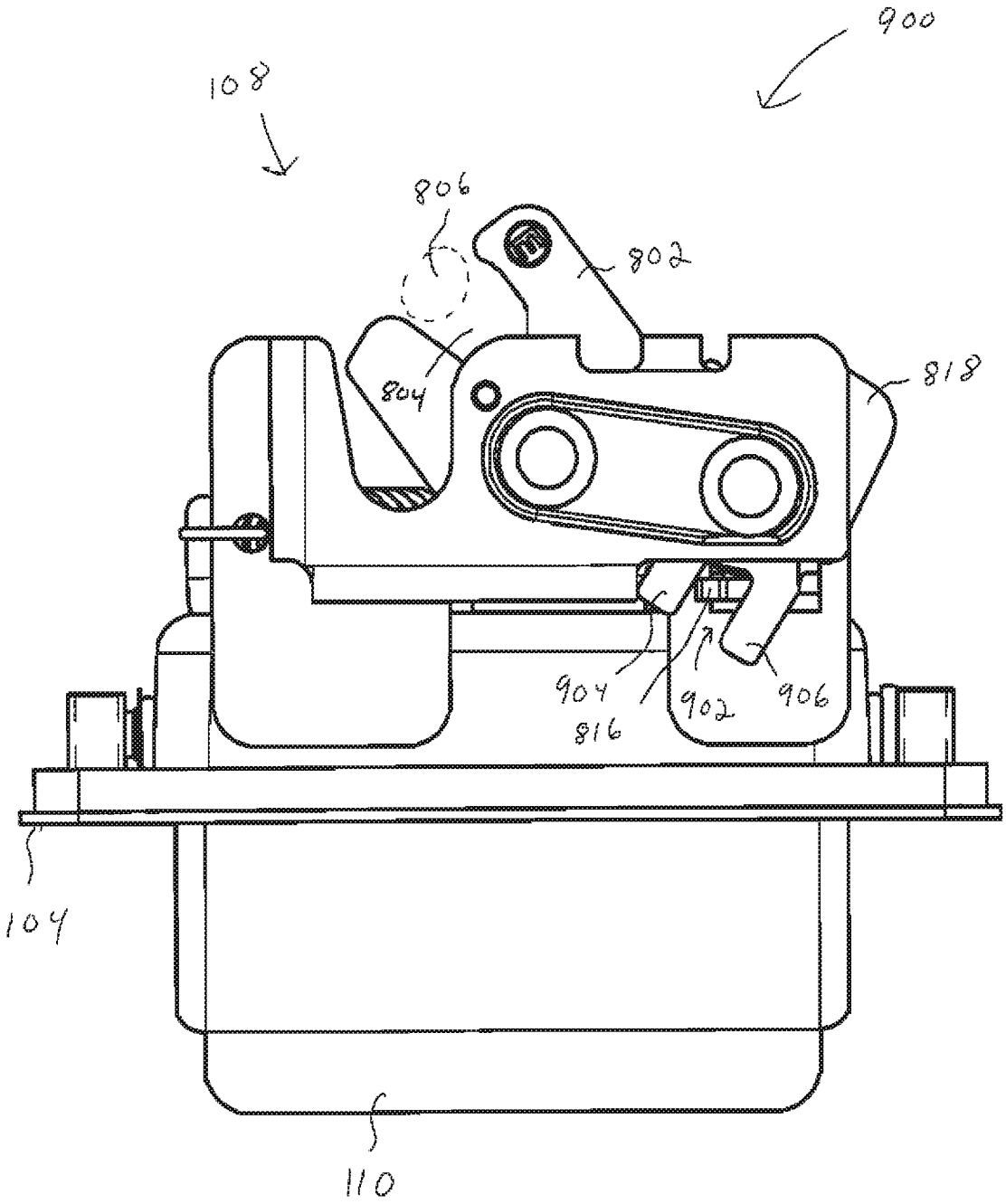
FIG. 9 is a top view of the example latch assembly.

FIG. 9 shows a top view 900 of the exemplary latch assembly 102 in order to more clearly show an example configuration of the latch mechanism 108 in the previously described unlatched condition. In this example, the rotary pawl 818 includes a recess or channel such as a "U" shaped notch 902 bounded by a first step or arm 904 and a second step or arm 906 which extend outwardly from the rotary pawl. The projection 816 of the actuation lever extends into the notch 902 between the first and second arms 904 and 906. Alternatively in other embodiments interengaging projections and recesses of other configurations may be used, and the positions of such features on the respective elements may be reversed or otherwise changed.

When the exemplary latch mechanism is in the unlatched condition, the features of the rotary pawl 818 that prevent the disconnect lever (shown in FIG. 8) from moving the trigger/handle to the retracted position include the configuration of the second arm 906. In the unlatched condition the second arm 906 engages and prevents the projection 816 from moving to the right as shown in FIG. 9. The arm 906 prevents the actuation lever and disconnect lever from rotating an amount necessary to cause the handle to be moved to the retracted position. Rather, the second arm 906 maintains the projection in a position that allows the handle to remain in the intermediate position.

Figure 10:
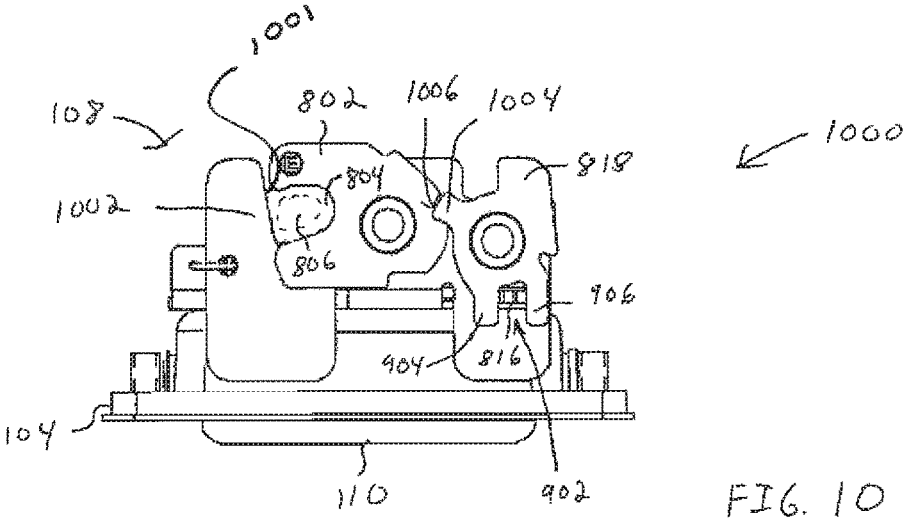
FIGS. 10-12 are inside views of different configurations of a latch mechanism of the example latch assembly in different configurations.
Figure 11:
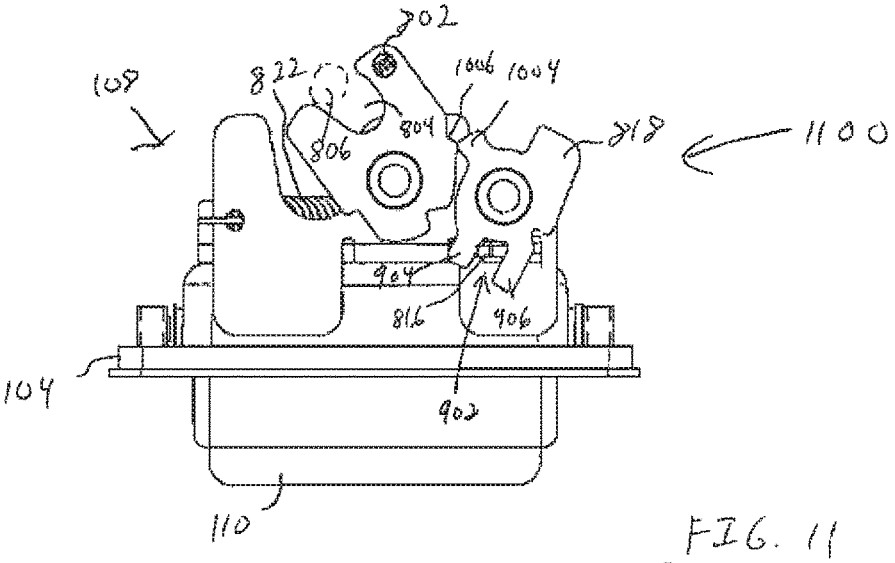
Figure 12:
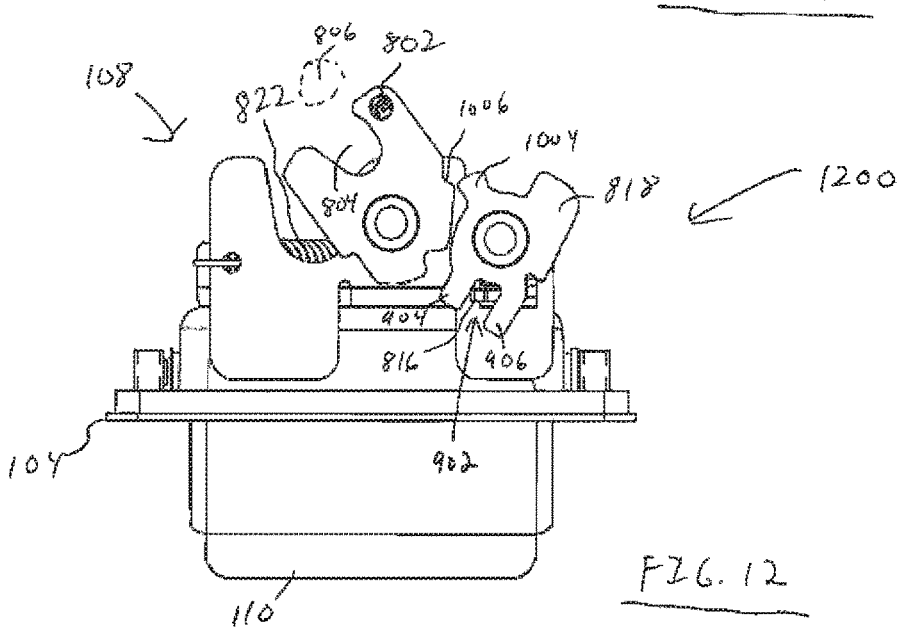

To show an example operation of the exemplary latch mechanism more clearly, FIGS. 10, 11, and 12 are internal top views 1000, 1100, 1200 of the latch assembly when the handle 110 is in the respective retracted, intermediate, and extended positions. These internal views show the catch jaw or rotary latch 802 and the release pawl 818 absent the outside cover of the latch mechanism. In FIG. 10, the latch mechanism 108 is shown in a latched condition. In FIGS. 11 and 12, the latch mechanism is shown in the unlatched condition.

Figure 15:
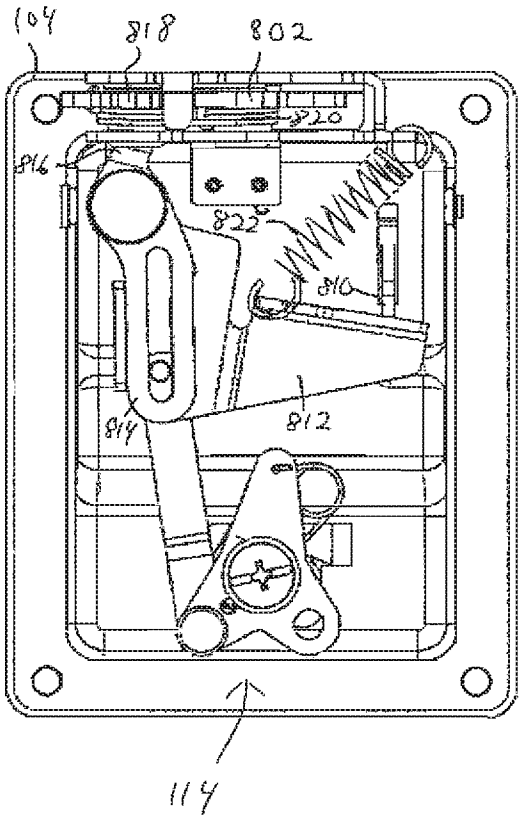
FIGS. 13-15 are back views of the example latch assembly in different configurations.
Figure 14:
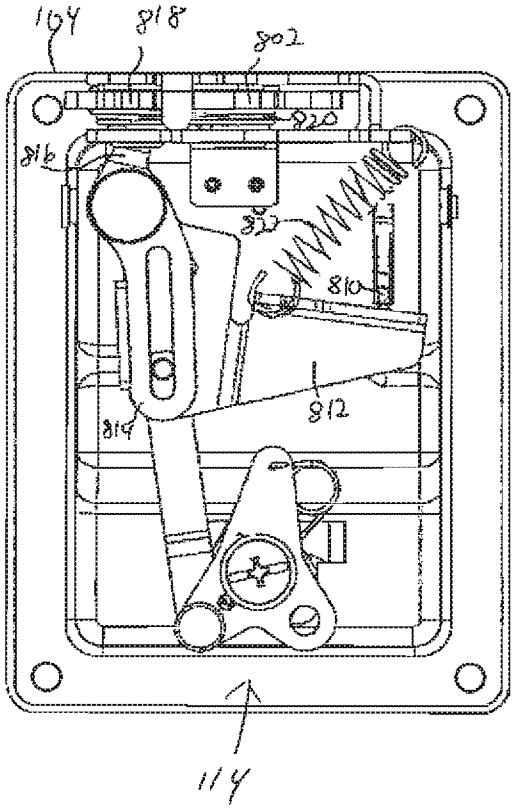
Figure 13:
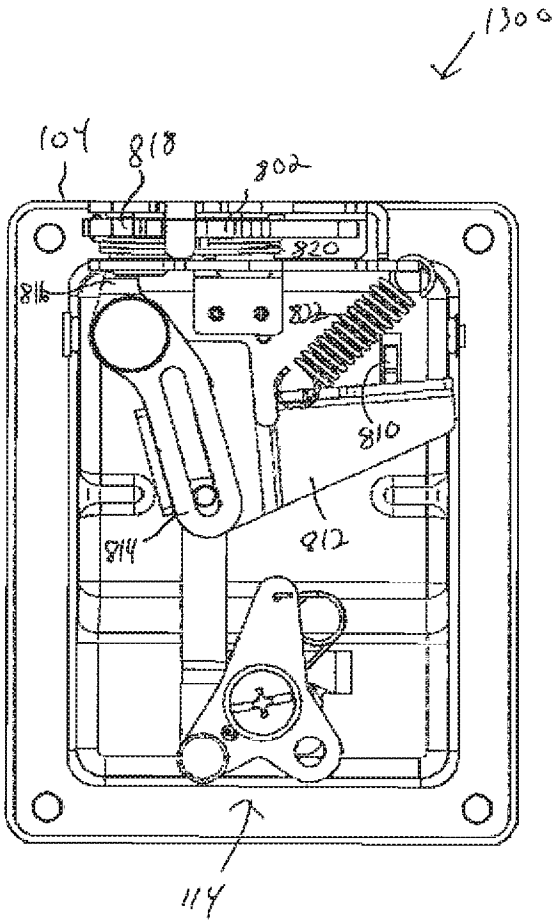

Also, to show an example operation of the release mechanism on the rear side of the housing more clearly, FIGS. 13, 14, and 15 are back views 1300, 1400, 1500 of the latch assembly when the handle is in the respective retracted, intermediate, and extended positions.

Referring to FIG. 10, when the latch mechanism is in the latched condition, the catch jaw or latch member 802 is rotationally positioned in a latched position such that the open end of the notch 804 is substantially bounded by surfaces 1001 on each wall/plate 1002 of the latch mechanism, only one of which is shown. Thus, in this position, a post or striker 806 is captured and remains engaged with the latch mechanism, and any door or hatch operatively connected to the striker is prevented from moving to an open position. In this latched configuration, a further projection 1004 on pawl 818 is operative to extend in and engage a further notch 1006 in the catch jaw of the rotary latch. The engagement of the projection 1004 in the notch 1006 prevents the catch jaw or rotary latch from rotating responsive to forces acting through the striker (e.g., a user attempting to open a door attached to the striker). Also, in this latched configuration, the second arm 906 of the rotary pawl is in a rotational position that enables the projection 816 of the actuation lever 814 to be in a position that enables the release mechanism to urge the handle to the retracted position.

FIG. 13 shows the relative positions of the actuation lever 814, disconnect lever 812 and trigger 810 when the latch mechanism is in the latched configuration and the handle is in the retracted position. As shown in FIG. 13, the spring 822 biases the disconnect lever 812 so as to rotate upwardly and thereby push the trigger 810 upwardly, which places the handle in the retracted position.

When a user pulls the handle outwardly to its maximum extension with respect to the receptacle of the housing, the trigger moves downwardly through the position shown in FIG. 14 (e.g., the intermediate position of the handle) to the position shown in FIG. 15 (the extended position of the handle). This handle movement causes the trigger to push against the disconnect lever 812 causing it to pivot clockwise as shown from FIG. 13 to FIG. 15. Also, when the lock mechanism 114 is in the unlocked configuration shown in FIGS. 13-15, the clockwise movement of the disconnect lever is operative to move the actuation lever 814 in the clockwise direction as well. As a result, the projection 816 on the actuation lever rotates clockwise and engages the surface bounding first step or arm 904 and urges the rotary release pawl 818 to move from an engaged position in which the pawl holds the catch jaw latch member in a latched position, to a release position in which the pawl releases the catch jaw or rotary latch 802 to move to an unlatched position.

For example, referring back to FIGS. 10-12, as the projection 816 moves in this described manner, the projection pushes the surface bounding the first step or arm 904 which causes the rotary pawl 818 to rotate clockwise from the engaged position shown in FIG. 10 through the release position shown in FIG. 11 and to the release position shown in FIG. 12. As the further projection 1004 of the rotary pawl rotates out of and disengages the further notch 1006 in the rotary latch, the catch jaw or latch member becomes free to move (responsive to a spring) so as to rotate clockwise from the latched position shown in FIG. 10, through the position shown in FIG. 11, to the unlatched position shown in FIG. 12.

When the user that is pulling on the handle lets go of the handle, the spring 822 (connected to the disconnect lever) is operative to cause the trigger to move upwardly at least a small amount. This movement of the trigger causes the disconnect lever, actuation lever, and rotary pawl to move counterclockwise at least a small amount to the positions shown in FIGS. 11 and 14 which corresponds to the intermediate position of the handle. However, further upwardly/counterclockwise movement of these elements is stopped at this position as a result of the further projection 1004 of the rotary pawl (shown in FIG. 11) contacting an edge bounding the rotary latch. This edge stops the rotary pawl from moving from the release position further counterclockwise back to the engaged position. As a result, the second arm 906 of the rotary pawl is operative to prevent further counterclockwise movement of the actuator lever and disconnect lever responsive to the biasing force of the spring 822.

Referring to FIG. 11, when a user closes a door/hatch that is operatively attached to the striker such that the striker 806 moves toward the latch mechanism, the force of the moving striker is operative to engage in the notch 804 and act on the rotary latch 802 and cause the rotary latch to rotate further counterclockwise as shown back to the position shown in FIG. 10. The rotation of the rotary latch to the latched condition places the further notch 1006 of the rotary latch in a position capable of receiving and engaging the further projection 1004 of the rotary pawl. Thus, with the rotary latch moving to this latched position, the rotary pawl rotates counterclockwise responsive to a spring (e.g., spring 822 and/or spring 820 shown in FIG. 8) from the release position to the engaged position so as to place the further projection in engagement with the further notch 1006.

In addition, as the rotary pawl rotates counterclockwise, the second arm 906 rotates counterclockwise to the position shown in FIG. 10. This enables the actuator lever, disconnect lever, trigger and handle to return to the positions shown in FIG. 10 and FIG. 13 (which correspond to the retracted position of the handle).

When the handle is in the extended position (see FIG. 7) or the intermediate position (see FIG. 6), the outwardly projecting/extending/angled orientation of the handle 110 relative to the housing 104 is of a sufficient degree to be visually apparent to a user of the latch assembly. In addition, to enhance the visual notification of the handle in the intermediate or extended positions, an example embodiment may further include at least one indicator surface on the handle that has a high visual contrast relative to other portions of the latch assembly such as the front facing surface of the handle and housing. For example, as shown in FIGS. 6 and 7, such an indicator surface may include adhesive labels 602 (having an orange, red, or other coloring or combination of colors). Such labels may be adhesively mounted to opposed side walls 604 of the handle 110 on opposed ends of the front facing surface of the handle.

As shown in FIG. 5, when the exemplary handle is in the retracted position with the latch mechanism in a latched configuration, such high contrast labels are not readily visible because they are disposed inside the walls bounding the receptacle of the housing. The inability to view such high contrast labels (especially from a sideways vantage point) may serve as a visual indicator that the door/hatch to which the latch assembly is mounted is closed and latched properly.

However in the exemplary arrangement, when the high contrast labels are visible by the handle sides extending out of the receptacle, such labels may serve as a visual indicator that the door or hatch is unlatched. Thus, for example, when the door to which the latch assembly is mounted appears closed but is not latched properly, the handle will be in the intermediate position shown in FIG. 6 and the visibility of the high contrast labels will serve as a warning that the door is not latched and needs to be properly closed.

In alternative embodiments, it should be appreciated that rather than labels, other types of high contrast elements may be applied to or integrated into the side walls 604 of the handle such as brightly colored paint, plastics, or any other material that forms a high contrast warning that the latch assembly is not yet latched. Alternatively other approaches to having an indicator that visibly shows that the latch assembly is not in the latched condition may be used. Such approaches may include for example other types of indicators on the handle sides or within the receptacle, for example.

In the configuration of the latch assembly shown in FIGS. 1-15, the lock mechanism 114 has been shown in an unlocked condition. As shown in FIG. 8, the example lock mechanism 114 may include a plate or cam 824 that rotates with the rotation of a portion of the lock cylinder 116 that can be turned via a corresponding proper key. In addition, the exemplary lock mechanism includes a lock arm 826 in pivoting connection with the cam via a pin 827. An end of the lock arm disposed from the cam includes a movable member in the form of a pin 828 that extends in movable relation through slots 830, 832 in the actuator lever 814 and disconnect lever 812, respectively.

When the lock mechanism is in the unlocked condition, the pin 828 extends in a lower portion of the slots 830, 832 that is disposed away from the pivot location 836. The walls bounding the slots 830 and 832 are disposed apart somewhat further than the diameter of pin 828 such that the pin is movable relative to the slots. In the position of the pin shown in FIG. 8, the pin serves to operatively connect in engaged relation the disconnect lever 812 and the actuator lever 814 such that these levers rotate together in the clockwise direction. Thus, when the handle 110 is moved to the extended position, the actuator lever 814 rotates in a corresponding manner responsive to rotation of the disconnect lever 812.

Figure 16:
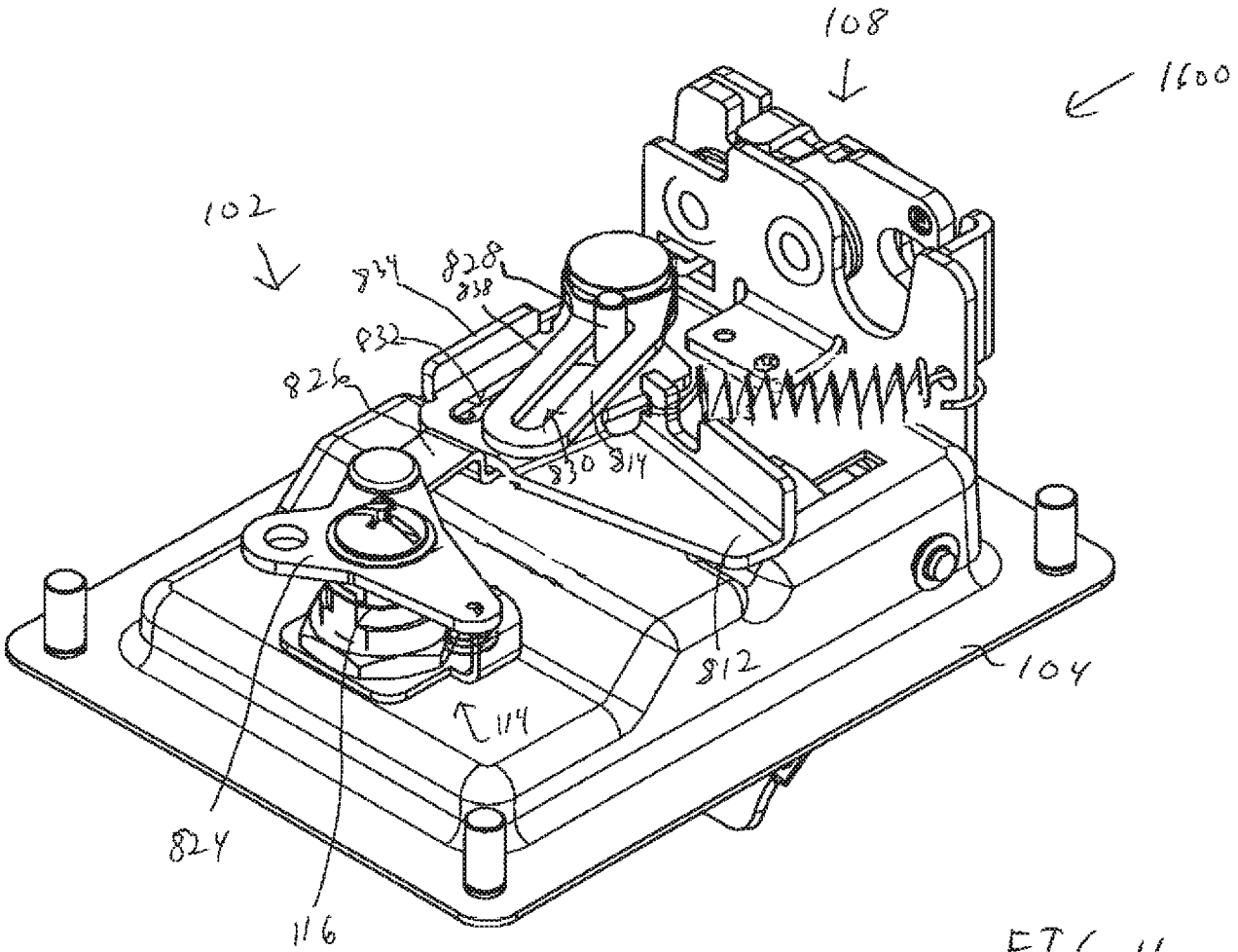
FIG. 16 is a rear, bottom, left side perspective view of the example latch assembly showing a lock mechanism in a locked configuration.

FIG. 16 is a perspective view 1600 of the rear of the exemplary latch assembly 102 when the lock mechanism is in a locked position. In this configuration, the rotation of the cam 824 has moved the lock arm 826 upwardly compared to the position shown in FIG. 8. In this configuration the pin 828 has moved to an upper portion of the slots 830, 832. As shown in FIG. 8A, the slot 832 in the disconnect lever includes a relatively wider upper portion 833 in proximity to the common pivot 836. For example, this wider upper portion 833 of the slot 832 of the disconnect lever extends outwardly beyond the wall bounding slot 830 of the actuator lever 814 and toward the side of the disconnect lever that engages the trigger 808.

The relatively wider upper portion 833 of the slot 832 enables the disconnect lever 812 to pivot counterclockwise without correspondingly moving the actuator lever 814. Thus, when the lock mechanism is selectively placed in the locked condition, the pin 828 is selectively positioned relative to both slots 830 and 832 so as to be closer to the pivot. In this position of the pin 828, the pin is aligned with the wider portion 833 of slot 832. With the pin 828 in this position, movement of the handle 110 (as shown in FIG. 16) to the extended position only causes the disconnect lever 812 to rotate counterclockwise as the walls bounding relatively wider upper portion 833 of the slot 832 does not engage the pin 828 and urge the pin to move. Because the pin 828 does not move when the disconnect lever moves, the actuation lever 814 also does not move. As a result, the projection 816 does not move the rotary pawl 818 and the latch mechanism 108 remains in the latched configuration. Thus, when the lock mechanism is in the locked condition, the handle may be moved back and forth between the retracted and extended position without causing the condition of latch mechanism to change to the unlatched condition.

As shown in FIGS. 8 and 16, it should be noted that the exemplary disconnect lever 812 includes a projection that is referred to as a flange 834. The flange 834 is operative to engage an edge 838 of the actuator lever 814. When the actuator lever is prevented from pivoting counterclockwise as a result of the latch mechanism being in the unlatched condition such as in FIG. 11, the edge of the actuator lever 814 contacts the flange 834 and prevents the flange and disconnect lever from rotating further counterclockwise responsive to the biasing force of spring 822. Thus, this described flange operates to prevent the disconnect lever from rotating counterclockwise. As a result the flange operates to transmit force and movement in one direction but not in the opposed direction. This avoids the need to rely on the pin 828 alone to carry out this function. As a result, fatigue and potentially eventual shearing of the pin that might otherwise occur is avoided.

It should be further noted that if the locking mechanism is placed in a locked condition (with the pin in the upper portions of the slots 830, 832) while the latch mechanism remains in the unlatched configuration shown in FIG. 8, the flange 834 is also operative to maintain the disconnect lever 812 in a position that maintains the handle in the intermediate position. Further, in this intermediate position, pushing the handle to the retracted position or pulling the handle to the extended position will not place additional stress on the mechanism components or change the positions of components of the latch mechanism 108.

Figure 18:
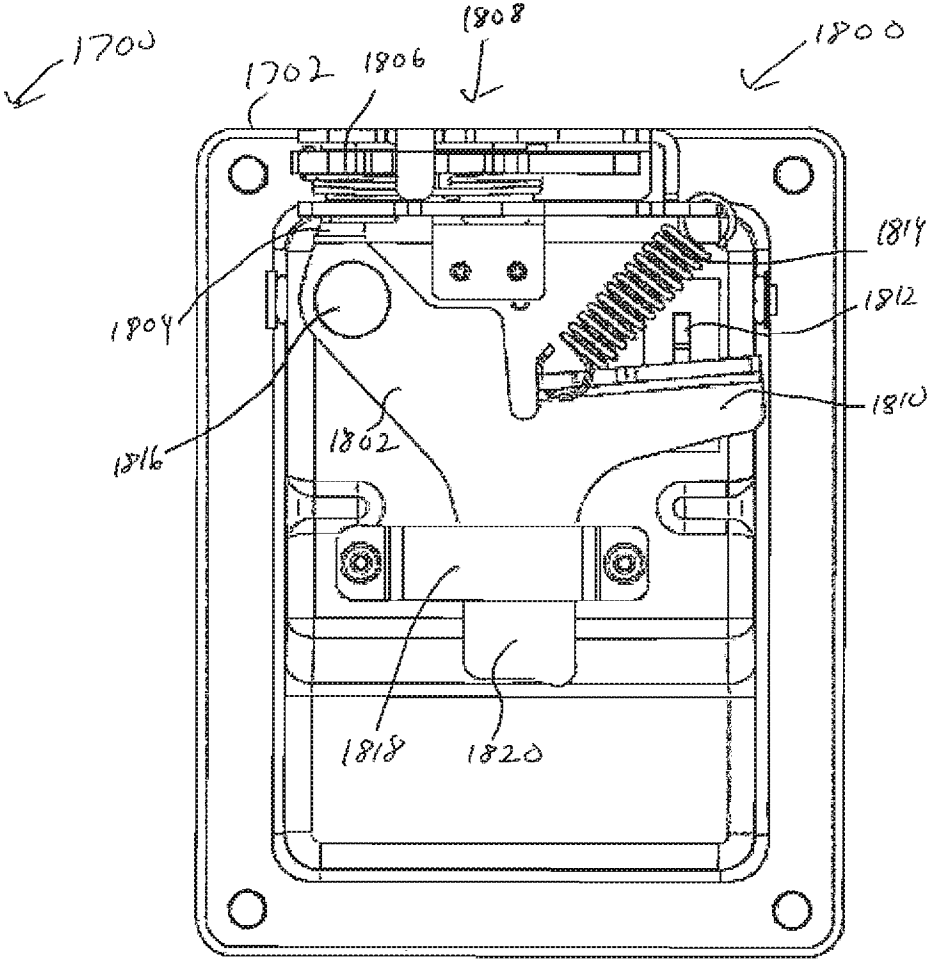
FIG. 18 is a rear view of the alternative latch assembly without a lock mechanism.
Figure 17:
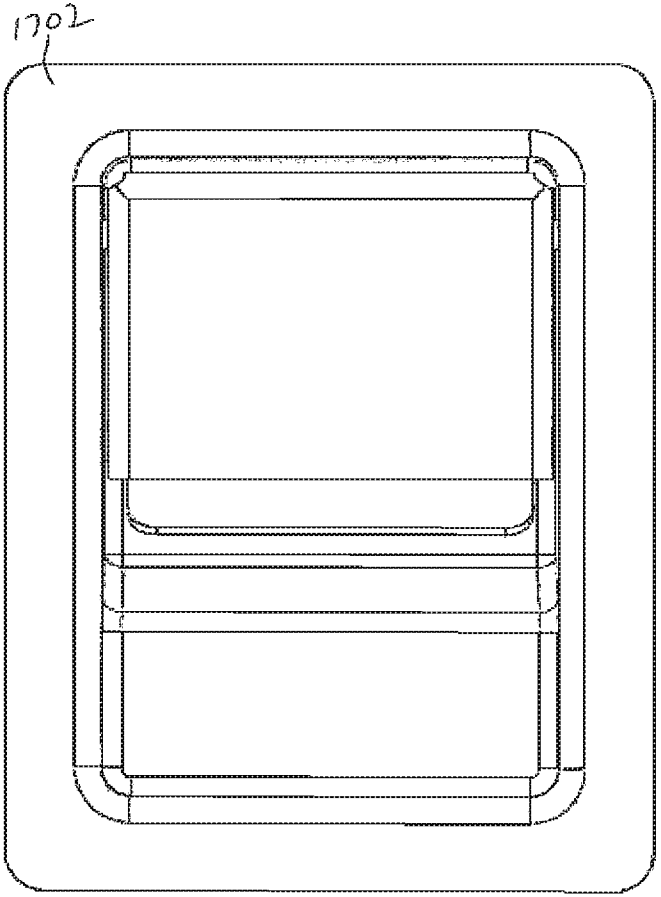
FIG. 17 is a front view of an alternative latch assembly without a lock mechanism.

It should be appreciated that some alternative embodiments of a latch assembly may not include a locking mechanism. As a result, the exemplary release mechanism described previously may have a different configuration compared to that shown in FIGS. 1-16. For example, FIG. 17 is a front view 1700 and FIG. 18 is a back view 1800 of an alternative embodiment of a latch assembly 1702 that does not include a lock mechanism. As shown in FIG. 18, rather than having separate actuation and disconnect levers as described in previous embodiments, the example latch assembly 1702 includes one lever 1802 with features from these previously described actuation and disconnect levers. Such a lever 1802 includes a projection 1804 that engages with the rotary pawl 1806 of a latch mechanism 1808 such as described in prior example embodiments. As is the case with levers 812 and 814 of the prior embodiments, lever 1802 rotates and moves in a plane.

In addition, in this exemplary embodiment the lever 1802 includes an end 1810 that is operative to engage and be moved by a trigger 1812 like that described in prior example embodiments. Also, the latch assembly 1702 includes a spring 1814 that is operative to urge the lever to rotate the first end 1810 towards the trigger 1812. The exemplary a lever 1802 is in pivoting connection with the housing of the latch assembly via a fastener such as a shoulder rivet or bolt 1816 mounted through an aperture in the lever to the housing of the latch assembly. In addition, to further support the lever and prevent the lever from twisting, the exemplary latch assembly includes a support bracket 1818 that extends across a body portion 1820 of the lever. The bracket and body portion serve as an interengaging guide and guide slot that guide the lever to move in its plane of movement and prevent movement transverse to the plane.

Figure 19:
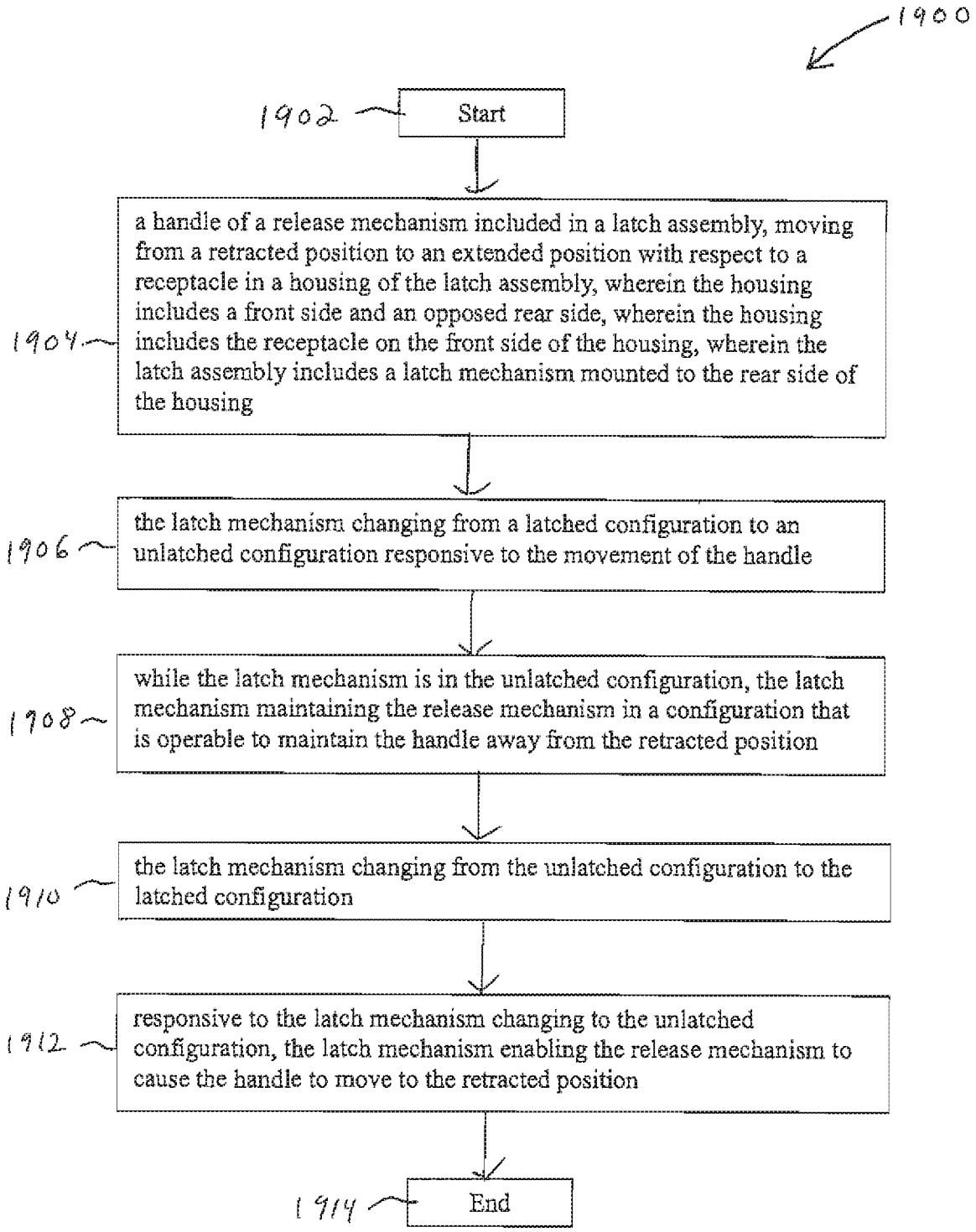
FIG. 19 is flow diagram that illustrates an example methodology for operating the latch assembly.

With reference now to FIG. 19, an example methodology is illustrated and described. While the methodologies are described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Referring now to FIG. 19, a methodology 1900 that facilitates operating the previously described latch apparatus is illustrated. The methodology 1900 begins at 1902, and at 1904 includes a handle of a release mechanism included in a latch assembly, moving from a retracted position to an extended position with respect to a receptacle in a housing of the latch assembly. As discussed previously, the housing may include a front side and an opposed rear side. Also, the housing may include the receptacle on the front side of the housing. In addition, the latch assembly may include a latch mechanism mounted to the rear side of the housing.

The methodology may also include a step 1906 in which the latch mechanism changes from a latched condition to an unlatched condition responsive to the handle moving in step 1904. At step 1908, while the latch mechanism is in the unlatched condition, the latch mechanism maintains the release mechanism in a configuration that is operable to maintain the handle away from the retracted position.

In addition, at step 1910, the exemplary latch mechanism changes from the unlatched configuration to the latched configuration, and at step 1912, responsive to changing to the latched configuration in step 1910, the latch mechanism enables the release mechanism to cause the handle to move to the retracted position. At step 1914 the methodology ends.

It should also be noted that this example methodology may include one or more of the functions and features of the latch assemblies described previously. For example, the methodology may include additional steps associated with a lock assembly changing between an unlocked and a locked configuration.

Figure 20:
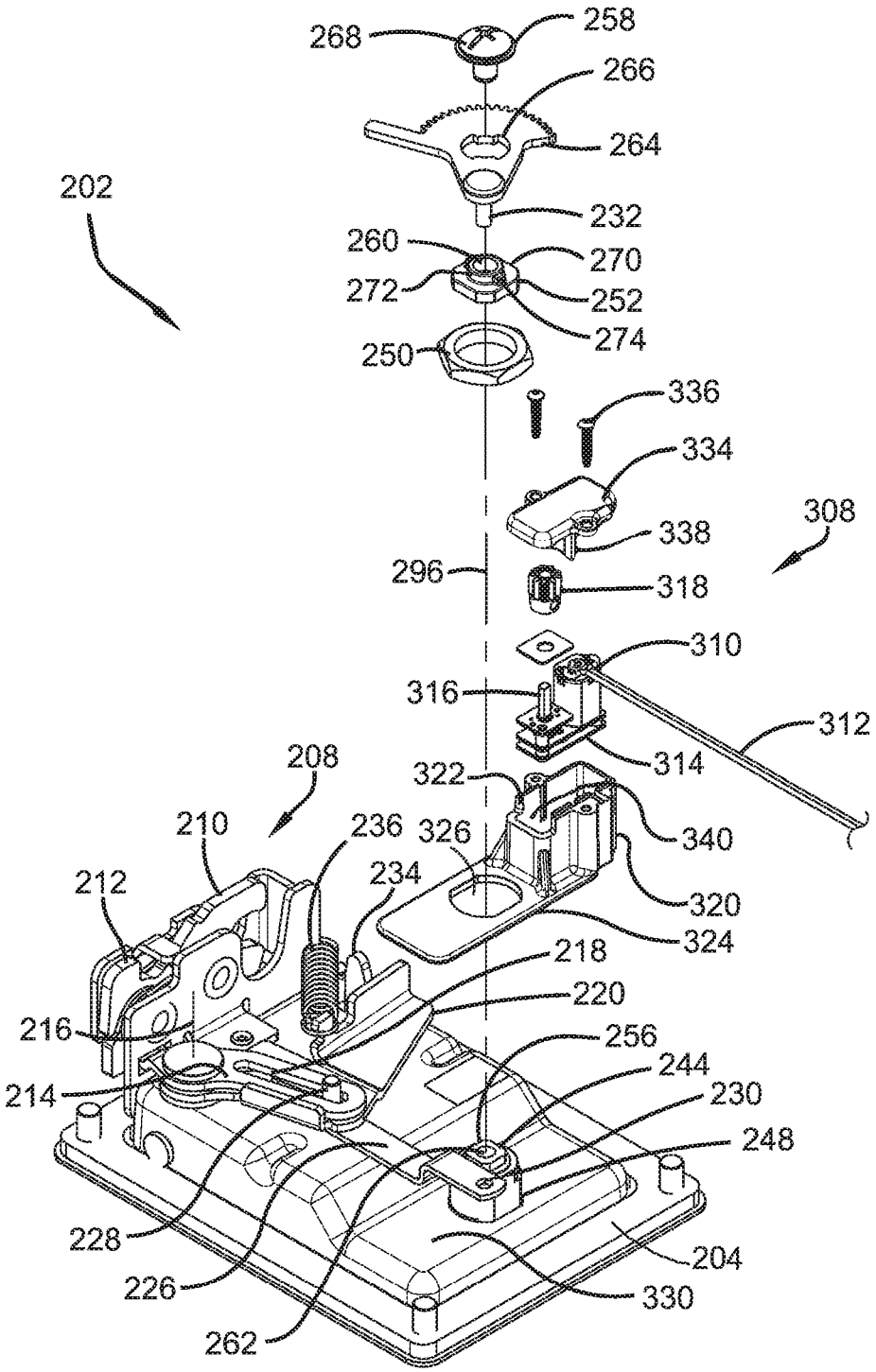
FIG. 20 is an exploded perspective back view of an exemplary latch and actuator.
Figure 21:
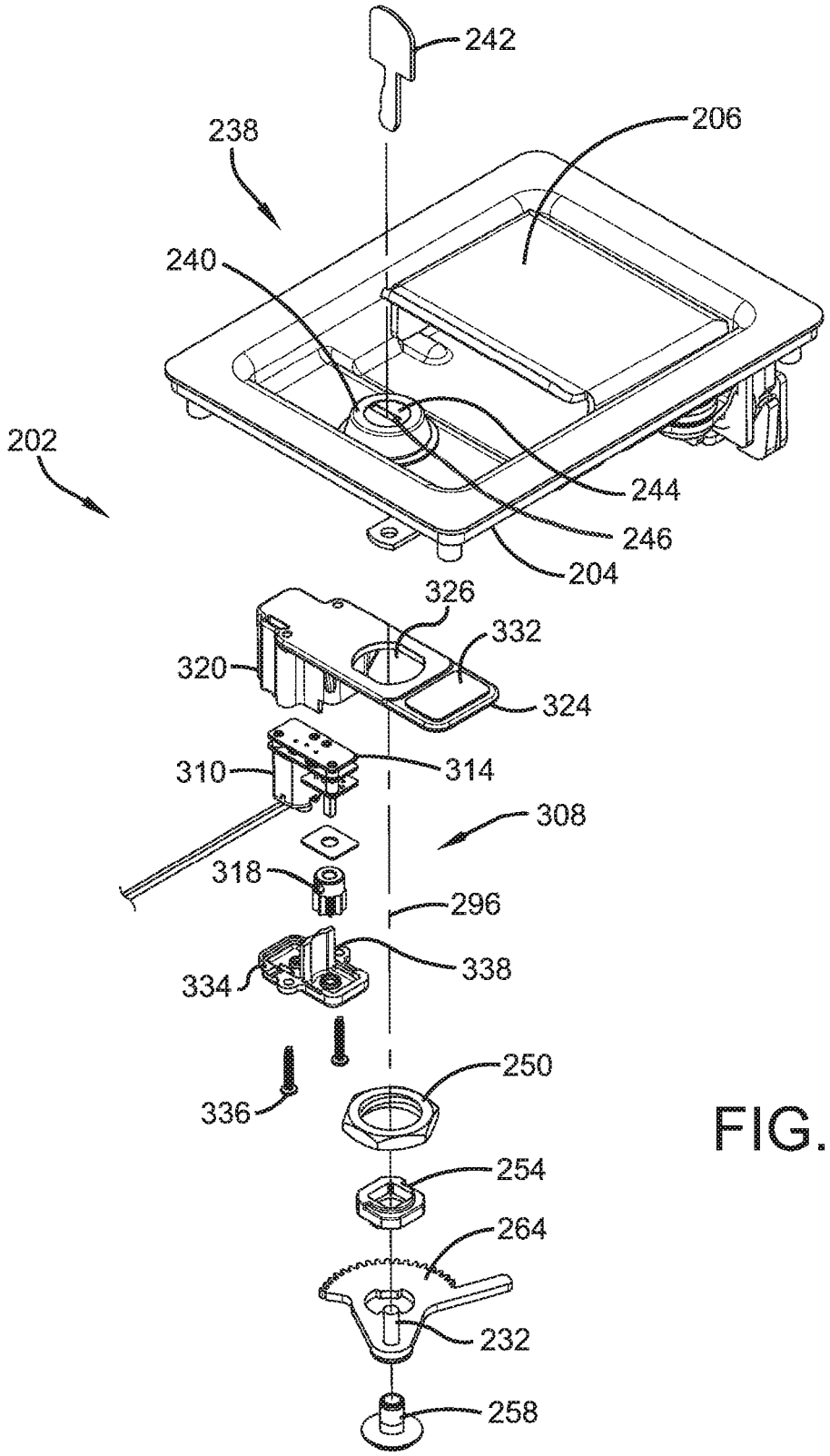
FIG. 21 is an exploded perspective front view of the latch shown in FIG. 20.
Figures 22, 23, 24, 25:
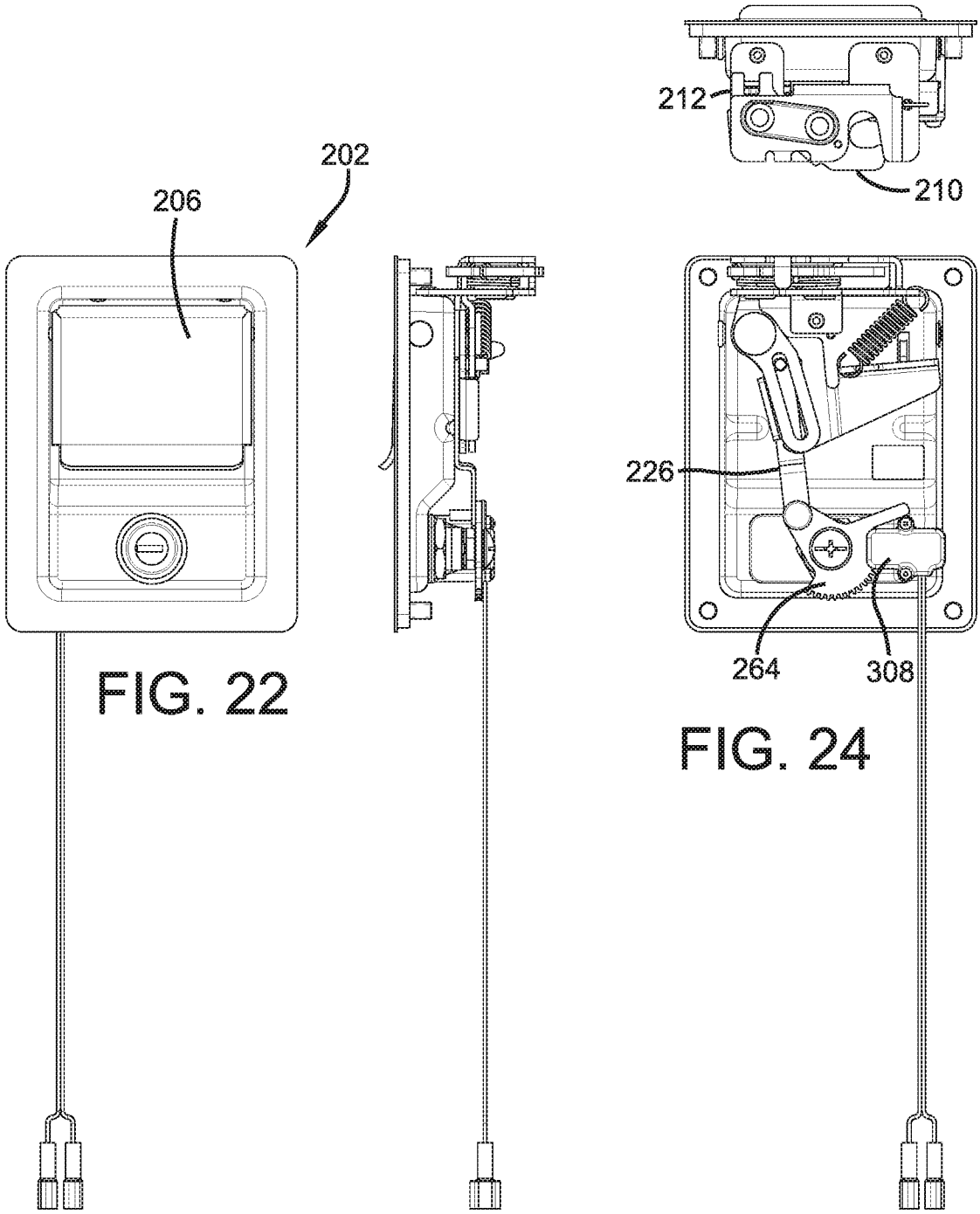
FIG. 22 is a front plan view of the latch assembly.
FIG. 23 is a side view of the latch assembly.
FIG. 24 is a back view of the latch assembly.
FIG. 25 is a top view of the latch assembly.

FIGS. 20-25 show an alternative example embodiment of a latch assembly 202. Similar to the previously described latch assemblies, latch assembly 202 includes a housing 204. As shown in FIG. 21 a pivoting handle 206 is movably mounted in connection with the housing 204.

Similar to previously described embodiments the assembly includes a latch 208. The latch includes a catch jaw 210. The catch jaw is rotatably movably mounted relative to the latch in a manner like that previously discussed, and includes a U-shaped notch which is engageable with the striker or post. The exemplary striker or post is in engagement with a closure member or other member that is selectively engaged with or released from engagement with the latch. The exemplary latch 208 further includes a release pawl 212. Similar to the release pawl in the previously described embodiments, the release pawl 212 is configured to be movable between an engaged position in which it holds the catch jaw in a latched jaw position, and a disengaged position in which the release pawl enables the catch jaw to move to an unlatched jaw position in which the striker or post is enabled to move out of the U-shaped notch in the catch jaw.

Similar to previously described embodiment, the latch assembly 202 further includes an actuation lever 214. Similar to actuation lever 814 previously discussed, actuation lever 214 is rotatable about a pivot axis 216. Similar to actuation lever 814, actuation lever 214 includes a projection which is operative to engage a step on the release pawl 212. Rotation of the actuation lever 214 is operative to move the release pawl through engagement with the pawl step, from the engaged position in which the release pawl holds the catch jaw in a latched jaw position, to a disengaged position of the release pawl in which the catch jaw is movable to the unlatched position. The actuation lever includes an elongated slot 218.

Figure 26:
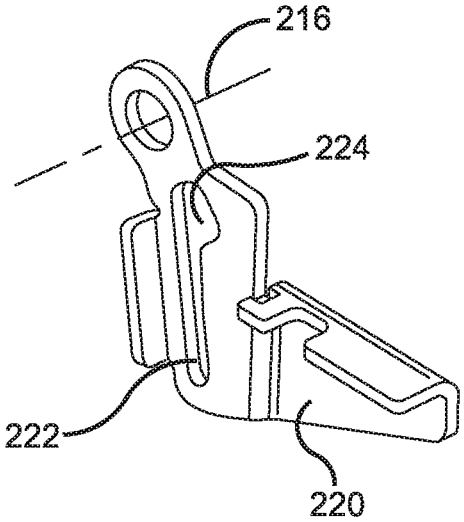
FIG. 26 is a perspective view of a disconnect lever used in exemplary latch assembly.
Figure 29:
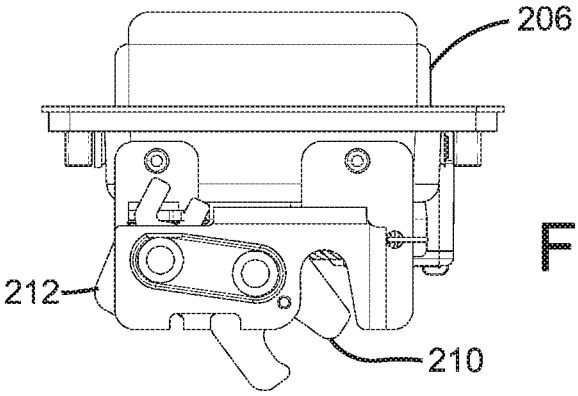
FIG. 29 is a top view of the latch assembly in an unlocked condition.
Figure 27:
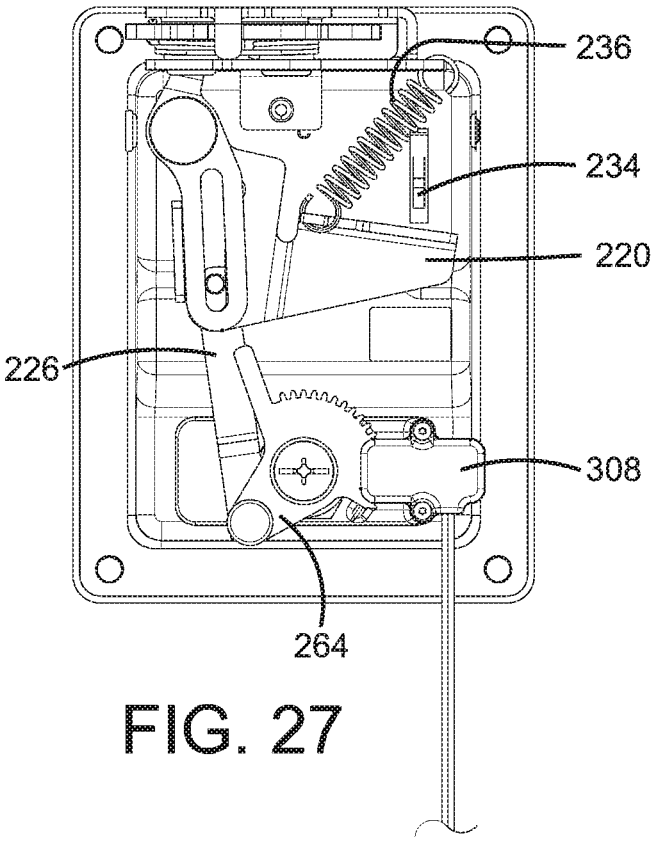
FIG. 27 is a back view of the latch assembly in an unlocked condition.

The latch assembly further includes a disconnect lever 220. In an exemplary embodiment the disconnect lever 220 is similar to disconnect lever 812 of the previously discussed embodiment. As shown in FIG. 26, the exemplary disconnect lever is rotatable about the pivot axis 216. Disconnect lever 220 includes a further lever slot 222. Similar to disconnect lever 812, the further lever slot 222 of disconnect lever 220 includes an enlarged portion 224 adjacent its upper end.

The latch assembly further includes a movable latch condition lever 226. In the exemplary embodiment latch condition lever 226 is similar to lock arm 826 of the previously described embodiment. Latch condition lever 226 is in operative connection with a pin 228. Pin 228 extends in elongated slot 218 of actuation lever 214 and in the further lever slot 222 of disconnect lever 220. Latch condition lever 226 further includes an opening 230 at an end opposed of pin 228. Opening 230 is sized to receive a pin 232 therein.

Figure 28:
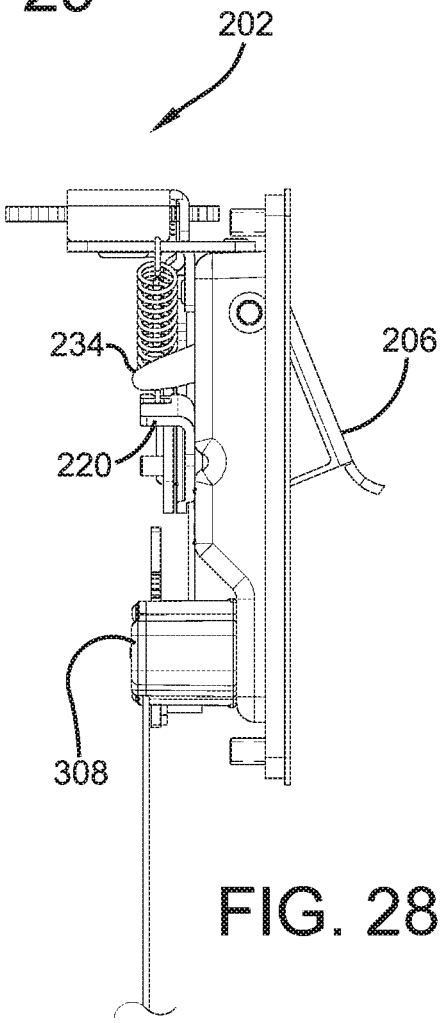
FIG. 28 is a side view of the latch assembly in an unlocked condition.

Similar to the previously described embodiment, the handle 206 is in operative connection with a trigger 234 that extends through an elongated slot in the housing 204. A spring 236 biases the disconnect lever 220 in a counterclockwise direction about the pivot axis 216 as shown in FIG. 20. Movement of the handle 206 outward from housing from the position shown in FIG. 22 to the position shown in FIG. 28 causes the trigger 234 to engage the disconnect lever 220. Movement of the trigger 234 causes the disconnect lever 220 to rotate in a clockwise direction against the biasing force of the spring 236 as shown in FIG. 20.

When the pin 228 is positioned in the lower portion as shown of the elongated slot 218 in the actuation lever 214 and in the lower portion of the further lever slot 222 in the disconnect lever 220, rotational movement of the disconnect lever 220 by the trigger causes movement of the actuation lever 214. Such movement of the actuation lever causes the projection thereon to move the release pawl 212 relative to the catch jaw from the engaged position to the disengaged position. Such movement of the release pawl causes the catch jaw 210 to be movable from the latched jaw position to the unlatched jaw position. Such movement of the catch jaw enables the striker or post to be disengaged therefrom.

Similar to previously described embodiment, when the latch condition lever 226 is positioned with pin 228 disposed in the upward area as shown of the elongated slot 218 of the actuation lever 214 and in the enlarged portion 224 at the upper portion of the further lever slot 222 in the disconnect lever 220, movement of the disconnect lever by the trigger does not cause movement of the actuation lever 214. This is because the pin 228 extends in the enlarged slot portion 224 of the disconnect lever as the disconnect lever moves responsive to movement of the trigger. As a result movement of the disconnect lever 220 is not transmitted to the actuation lever 214 and the actuation lever 214 remains stationary. As a result the actuation lever does not change the position of the release pawl 212 and the catch jaw 210 remains latched in engagement with the striker or post.

The exemplary latch assembly further includes a lock 238. The exemplary lock comprises a keylock 240. Keylock 240 can be changed between the locked and unlocked conditions through engagement with a proper key 242. Keylock 240 includes a rotatable lock cylinder 244. Lock cylinder 244 includes a slot 246 which is configured to receive the key 242 therein. The lock cylinder 244 extends in and is rotationally movable within a cylindrical lock barrel 248. Lock barrel 248 extends through an opening in the housing 204. Lock barrel 248 is externally threaded and is engageable by a barrel nut 250. The barrel nut 250 is operative to hold the lock barrel in engagement with the housing in a manner later discussed.

The lock cylinder 244 is engaged with a cylinder cap 252. The cylinder cap 252 includes a recess 254 in its inner side which is generally rectangular in shape. The recess 254 receives a rectangular projection 256 that extends axially outward on the back face of the lock cylinder 244. The engagement of the projection and recess are operative to maintain the cylinder cap 252 in generally fixed relative angular relation with the lock cylinder. As a result when the proper key 242 is inserted in the lock cylinder, the cylinder 244 and the cap 252 are rotatable together with rotation of the key about an axis 296. When the key is disengaged from lock cylinder, the lock cylinder and the cap are in an immovable fixed rotational position.

A fastener 258 extends through an opening 260 in cap 252. The fastener 258 includes a threaded portion that threadably engages a threaded recess 262 in the lock cylinder 244. The fastener 258 also extends through a plate 264. Plate 264 includes an opening 266 through which the fastener 258 extends. In the exemplary arrangement the fastener 258 includes a head portion 268 that is sized to overlie the opening 266 in the plate 264. Further in the exemplary arrangement the fastener is configured to enable the plate 264 to rotationally move relative to the cap 252 in a manner later discussed.

As shown in FIG. 20 cap 252 includes a generally flat face surface 270. The plate 264 is rotationally movable in abutting relation with the face surface. An annular ring 272 extends axially outward from face surface 270. The opening 260 through which the fastener 258 extends is concentric with the annular ring 272. A pair of diametrically opposed projections 274, 276 extend radially outward from the annular ring 272 as shown in FIGS. 32-35.

Figure 32:
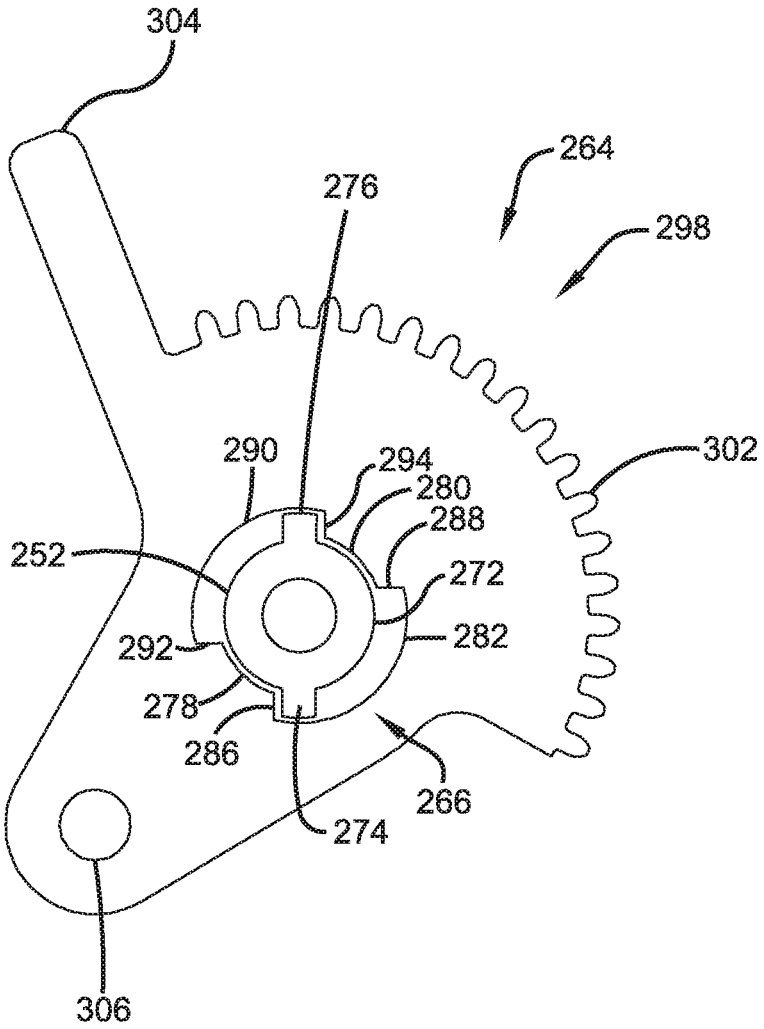
FIG. 32 is a back view of a plate and cap used in an exemplary embodiment in a first rotational position corresponding to an unlocked condition of the latch.
Figure 33:
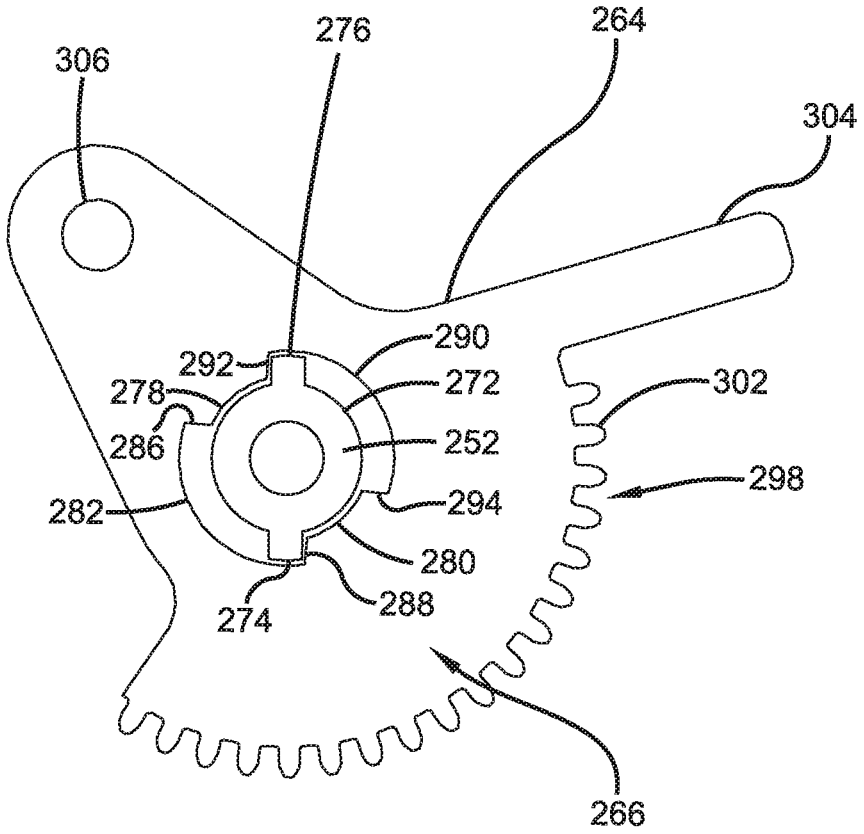
FIG. 33 is a back view of the plate and cap with the plate in a second rotational position corresponding to a locked condition of the latch.

As shown in FIG. 32 and FIG. 33 the opening 266 in plate 264 includes a pair of arcuate portions 278, 280. The arcuate portions 278, 280 are in generally close fitting relation with the annular outer surface of ring 272 of cap 252. An arcuate slot 282 extends between radially extending end surfaces 286, 288. Arcuate slot 282 extends through an angle of at least 90° and is sized to enable projection 274 to move therein. An arcuate slot 290 extends between radially extending end surfaces 292, 294. Arcuate slot 290 extends through an angle of at least 90° and is configured to enable projection 276 to move therein. In the exemplary arrangement the head portion 268 of fastener 258 overlies arcuate slots 282 and 290 and holds the plate 264 in movable engagement with the cap 252. This enables the plate 264 to be rotationally movable relative to the axis 296 of the lock cylinder 244.

Exemplary plate 264 includes an arcuate edge 298. Arcuate edge 298 includes an arcuate gear segment 302. Plate 264 further includes a radially outward extending plate projection 304. Plate 264 further includes an opening 306. Pin 232 extends through opening 306 and is in connection with the latch condition lever 226.

Figure 40:
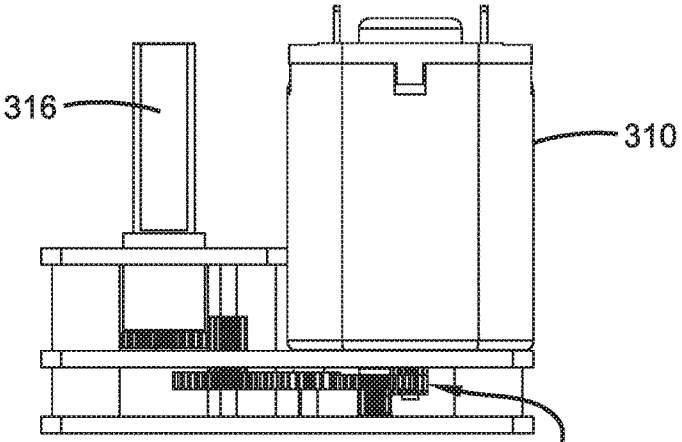
FIG. 40 is a front view of the motor, transmission and pinion shaft assembly of an exemplary actuator.

The latch apparatus further includes an actuator 308. Actuator 308 includes a motor 310. The motor 310 is in operative connection with electrical leads 312 which are operative to supply power to the motor. As best shown in FIG. 40 the motor is in operative connection with a transmission 314. Exemplary transmission 314 includes a plurality of gears that connect the rotatable output shaft of the motor with a pinion shaft 316. The transmission 314 is operative to reduce the speed output by the motor for purposes of rotating the pinion shaft 316. The pinion shaft is in operative connection with a pinion 318. The pinion 318 is held in fixed connection with the pinion shaft 316 via a set screw or other fastening device.

The actuator 308 further includes a case 320. The case includes an interior area 322 in which the motor 310, transmission 314 and pinion 318 are positioned. In the exemplary arrangement the case includes an integrally formed base 324. The base extends generally transversely relative to the portion of the case 320 housing the motor. The base includes a base opening 326. The barrel 248 of the keylock 240 extends through the base opening 326. In the exemplary arrangement a bottom surface 328 of the base abuts a generally planar portion 330 of the backside of the housing 204 that extends adjacent to the lock barrel 248. In an exemplary arrangement an adhesive layer 332 is adhered to the bottom surface 328 and holds the base 324 in engagement with the planar portion 330 of the housing. In addition, in the exemplary arrangement the barrel nut 250 is engaged with the threaded barrel and is in abutting engagement with the base to hold the base in sandwiched engagement between the nut and the housing.

The exemplary actuator 308 further includes a case cover 334. The case cover 334 is releasably engaged with the case 320. Fasteners 336 are used to hold the case 320 and the case cover 334 in engagement. The exemplary case cover further includes an inward extending projection 338. Projection 338 is operative to engage and hold the motor, transmission and pinion assembly in the proper position within the interior area 322 of the case.

In the assembled condition of the actuator 308, the case 320 and the case cover 334 are operative to bound a slot 340. Slot 340 is a laterally extending slot that is sized to enable the arcuate gear segment 302 of the plate 264 to extend therein. The arcuate gear segment engages the pinion 318 in the interior area of the case of the actuator through the slot 340. This configuration helps to guide the gear segment through its rotational range of motion and prevent the gear segment from disengaging from the pinion. Of course this approach is exemplary and other embodiments other approaches may be used.

In the exemplary arrangement the actuator 308 enables the condition of the latch to be changed between the locked and unlocked conditions while the keylock remains locked. Further in the exemplary arrangement the latch is enabled to be changed between the locked and unlocked conditions by changing the condition of the lock through rotation of a proper key in engagement with the lock, without electrical actuation of the actuator.

Figure 30:
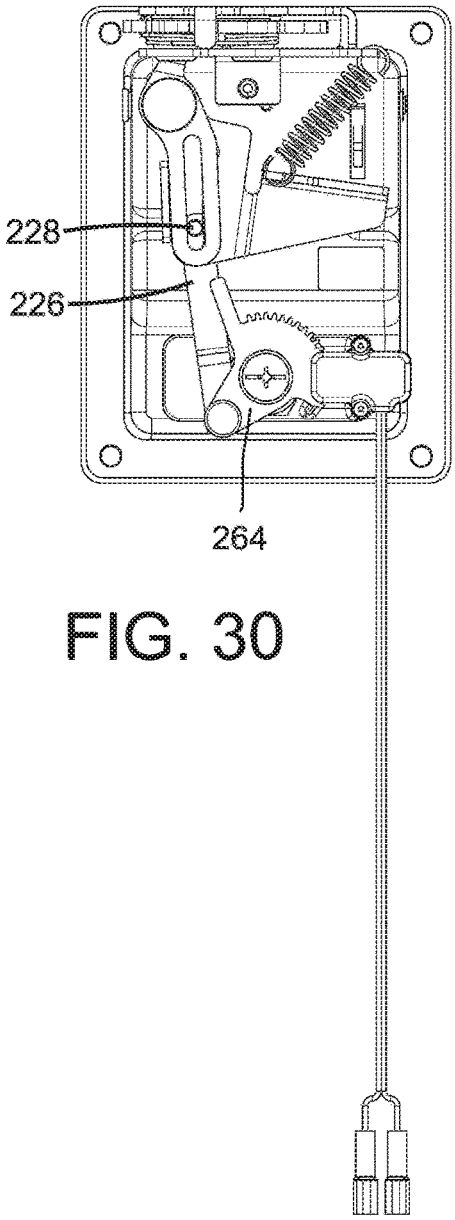
FIG. 30 is a back view of the latch assembly in an unlocked condition.
Figure 31:
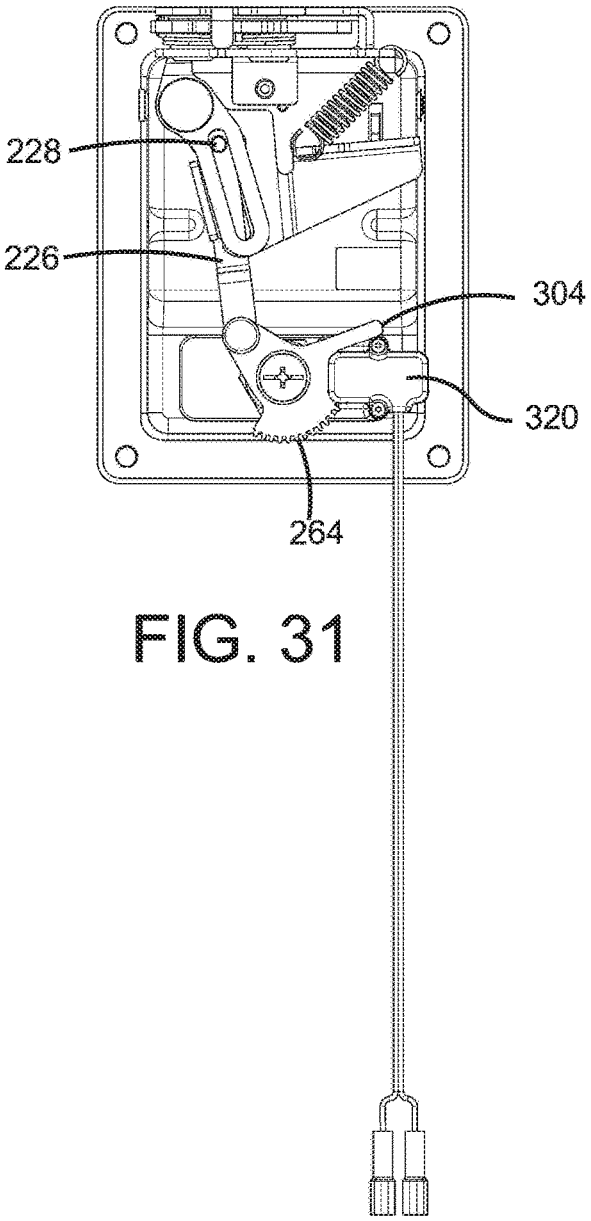
FIG. 31 is a back view of the latch assembly moved to a locked condition through operation of an exemplary actuator.

The rear of the latch assembly is shown in FIGS. 30 and 31. In these figures the case cover 334 of the actuator is shown as being removed so that the motor and pinion are visible. As previously discussed, during operation of the actuator the case cover 334 would be installed in engagement with the case 302 so as to assure engagement of the plate 264 and the pinion 318. As shown in FIGS. 30 and 31 the cylinder of the lock is held immovable in a first rotational cylinder position. This would be a position when the proper key is not engaged with the lock and would generally correspond to a locked condition of the lock. As shown in FIG. 31, the plate 264 is rotationally positioned so that the plate projection 304 is in abutting engagement with the outside surface of the case 320. In this position the latch condition lever 226 is positioned such that the pin 228 is disposed upwardly in the elongated slot 218 and the further lever slot 222. As previously discussed, in this position of the pin and latch condition lever, movement of the handle 206 will not cause the latch to change from a latched condition to unlatched condition.

FIG. 33 corresponds to the relative positions of the plate 264 and the cap 252 in the condition of the latch shown in FIG. 31. As can be seen the projections 274 and 276 are positioned adjacent to the end surfaces 288 and 292 respectively.

Rotation of the motor in a first direction is operative to cause plate 264 to rotate from the rotational position shown in FIG. 31 to the position shown in FIG. 30. The rotation of plate 264 is operative to cause the latch condition lever 226 to be disposed downwardly relative to the position of the lever in FIG. 31. The pin 228 which is connected to lever 226 correspondingly moves downward in elongated slot 218 and further lever slot 222. In the position shown in FIG. 30 movement of the handle 204 is operative to cause the latch to change from the latched condition to the unlatched condition.

The position of plate 264 in the condition of the latch shown in FIG. 30 is represented in FIG. 32. As can be seen the projections which extend radially outward from the cap 252 are in the same positions as in FIG. 33. However the plate is rotated such that end surface 294 is adjacent to projection 276 and end surface 286 is adjacent to projection 274. Thus as can be appreciated, the condition of the latch is changed from a locked condition to an unlocked condition while the keylock remains in the locked position and cylinder remains immovable due to the absence of the key in the lock. Thereafter rotation of the motor in an opposed rotational direction is operative to return the plate 264 and latch condition lever 226 from the position shown in FIG. 30 to the position shown in FIG. 31. Thus as can be appreciated the actuator 308 is enabled to change the condition of the latch between the locked and unlocked conditions independent of the operation of the keylock.

Figure 34:
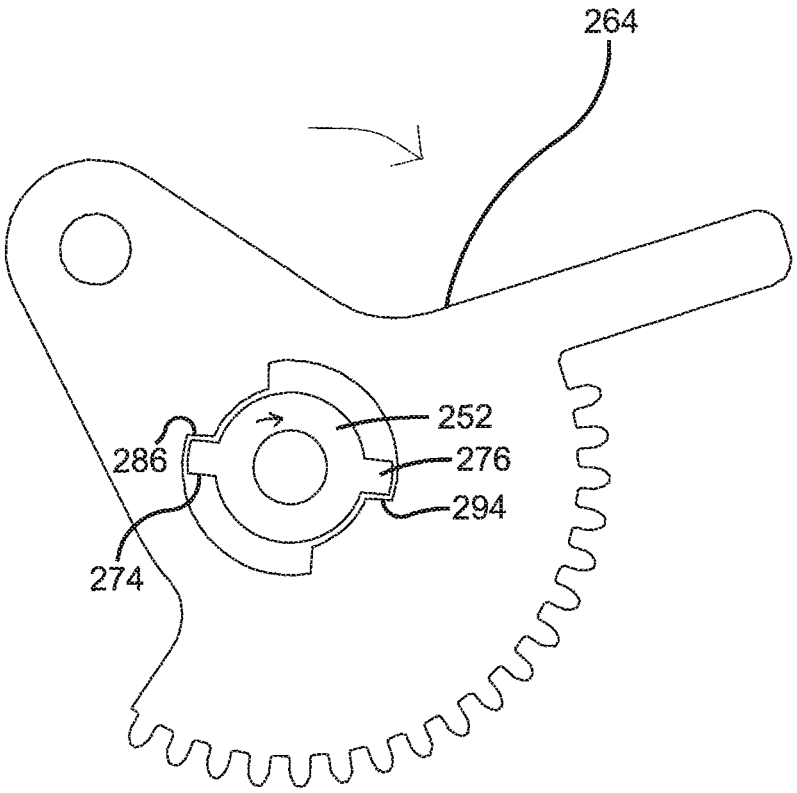
FIG. 34 is a back view of the plate with the cap rotated to engage the end surfaces of the slots in the plate and to rotate the plate to a position corresponding to a locked condition of the latch.
Figure 35:
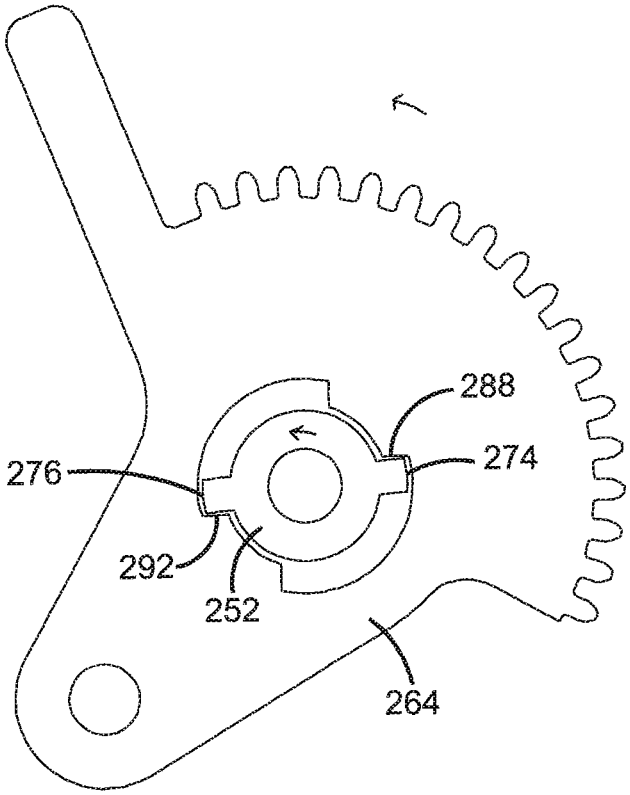
FIG. 35 is a back view of the plate with the cap rotated to engage the end surfaces of the slots in the plate and to rotate the plate to a position corresponding to an unlocked condition of the latch.
Figure 36:
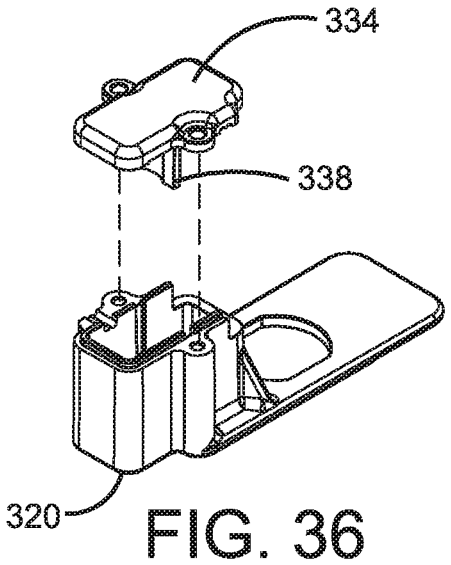
FIG. 36 is a top front perspective view of the actuator case and cover.
Figure 37:
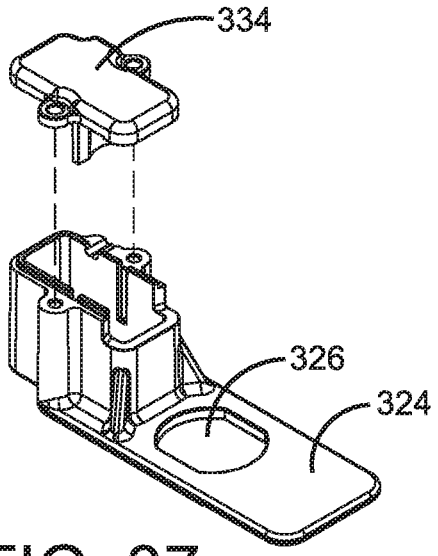
FIG. 37 is a top back perspective view of the actuator case and cover.
Figure 38:
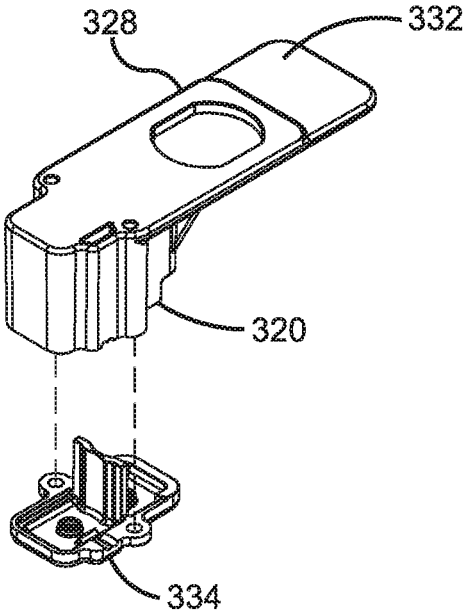
FIG. 38 is a bottom front perspective view of the actuator case and cover.
Figure 39:
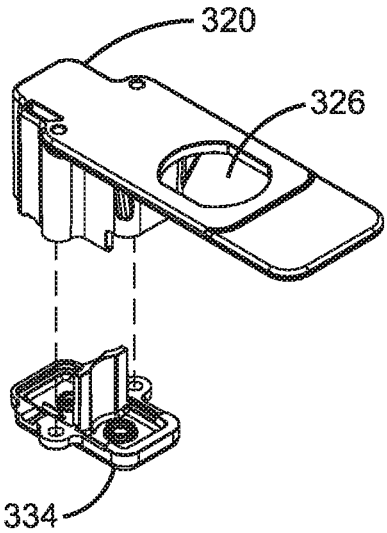
FIG. 39 is a bottom back perspective view of the actuator case and cover.
Figure 41:
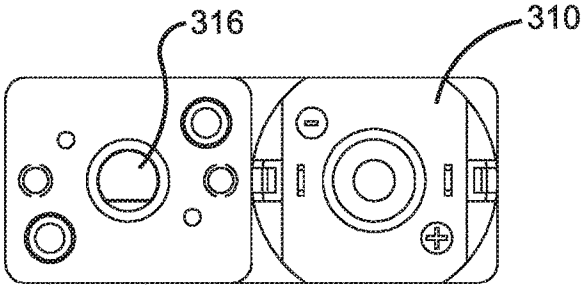
FIG. 41 is a top view of the motor, transmission and pinion shaft assembly.
Figure 42:
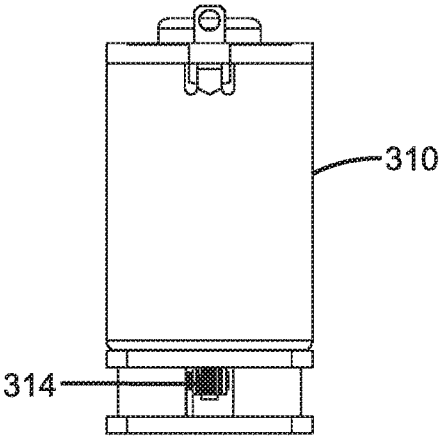
FIG. 42 is a right-side view of the motor and transmission assembly.

In the exemplary arrangement the keylock 240 may be used independent of the actuator 308 to change the latch between the locked in the unlocked conditions. As represented in FIG. 34 and FIG. 35 placing the proper key in engagement with the key cylinder enables rotation of the key cylinder in a manner that rotates the plate 264. As shown in FIG. 35 the cap 252 may be rotated responsive to rotation of the key cylinder by the key in a counterclockwise direction viewed from the rear of the latch, from the immovable position shown in FIG. 32 in which the cylinder is held when the key is not present. This causes the projections 274 and 276 to be engaged with the end surfaces 288 and 292 respectively. This enables the cap 252 to rotationally move the plate 264 counterclockwise to the position in which the latch condition lever 226 places the latch in the unlocked condition. Similarly rotation of the cap 252 in a clockwise direction when viewed from the rear of the latch causes the plate 264 to move clockwise. This occurs because of the engagement of projections 274 and 276 with end surfaces 286 and 294 respectively. Thus in the exemplary embodiment latch can be changed between locked and unlocked conditions without electrical actuation of the actuator.

Further as can be appreciated, in the exemplary arrangement because the immovable position of the key cylinder when the key is removed is such that the projections associated with the cap 252 are movable within the arcuate slots that extend in the plate, having the keylock in the locked position does not prevent changing the condition of the latch through operation of the actuator. Of course it should be understood that the arrangement of projections and slots used in the exemplary embodiment is but one of many configurations that may be utilized in connection with latch and actuator constructions. In addition the exemplary latch configuration which utilizes an actuation lever and disconnect lever connected through a movable pin is but one example of a type of latch that may have its condition changed through movement of a latch condition lever. Numerous other latch configurations may be utilized with members that change the latch condition responsive to movement by actuators that are within the scope of the principles described herein.

It is noted that several examples have been provided for purposes of explanation. These examples are not to be construed as limiting the hereto-appended claims. Additionally, it may be recognized that the examples provided herein may be permutated while still falling under the scope of the claims.

Thus the exemplary embodiments described herein achieve improved operation, eliminate difficulties encountered in the use of prior devices, systems and methods and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited to the features shown and described.

Having described the features, discoveries and principles of the exemplary embodiments, the manner in which they are constructed and operated and the advantages and useful results attained, the new and useful structures, devices, elements, arrangements, parts, combinations, systems, equipment, operations, methods, processes and relationships are set forth in the appended claims.

We claim:

1. Apparatus comprising:

an actuator configured for use with a latch, wherein the latch includes a movable latch condition lever, wherein the latch condition lever is movable between a first condition lever position and a second condition lever position, wherein the latch includes a manually movable handle, wherein when the latch condition lever is in the first condition lever position, movement of the handle is operative to cause the latch to change from a latched condition to an unlatched condition, wherein when the latch condition lever is in the second condition lever position, movement of the handle does not cause the latch to change from the latched condition to the unlatched condition, wherein the actuator includes a key lock, wherein the key lock includes a rotatable lock cylinder, wherein the lock cylinder is rotatable about a cylinder axis, wherein the lock cylinder is held immovable in a first rotational cylinder position when a proper key is not in operative engagement with the key lock, wherein the lock cylinder is rotationally movable from the first rotational cylinder position in a first rotational direction and in an opposed second rotational direction when the proper key is in operative engagement with the key lock, a projection, wherein the projection extends radially outward relative to the cylinder axis and is in fixed operative connection with the lock cylinder, a movable plate, wherein the plate includes an arcuate slot, wherein the arcuate slot is bounded at opposed ends of the slot by first and second radially extending end surfaces, wherein the projection extends in the slot and is movable therein between the first and second end surfaces without causing plate movement, and wherein the plate is in operative connection with the latch condition lever, an arcuate gear segment, wherein the gear segment is in fixed operative connection with the plate, a motor, a rotatable pinion in operative connection with the motor, wherein the pinion is in operatively engaged connection with the arcuate gear segment, wherein with the proper key in engagement with the key lock, responsive to rotation of the lock cylinder in the first rotational direction from the first rotational cylinder position, the projection is operative to move in the arcuate slot and engage the first end surface of the slot to cause plate movement and the latch condition lever to move from the second condition lever position to the first condition lever position, responsive to rotation of the lock cylinder in the second rotational direction opposed of the first rotational direction from the first rotational cylinder position, the projection is operative to move in the arcuate slot and engage the second end surface of the slot opposed of the first end surface to cause plate movement and the latch condition lever to move from the first condition lever position to the second condition lever position, and wherein with the proper key not in engagement with the key lock and the lock cylinder held immovable in the first rotational cylinder position, motor rotation in a first rotational motor direction is operative to cause plate movement with the projection positioned in the arcuate slot between the first and second end surfaces, and the latch condition lever to move from the second condition lever position to the first condition lever position, motor rotation in a second rotational motor direction opposed of the first rotational motor direction is operative to cause plate movement with the projection positioned in the arcuate slot between the first and second end surfaces, and the latch condition lever to move from the first condition lever position to the second condition lever position.

2. The apparatus according to claim 1
wherein the case has a releasable cover,
wherein the releasable cover bounds the case slot and prevents disengagement of the arcuate gear segment and the pinion,
wherein the cover is held in engagement with the case through at least one releasable cover fastener.

3. The apparatus according to claim 1
and further including a generally planar base,
wherein the case is in fixed attached engagement with the base,
wherein the base includes a base opening,
wherein the key lock extends in the base opening.

4. The apparatus according to claim 3
wherein the key lock includes an externally threaded barrel and a barrel nut, wherein the lock cylinder rotates within the barrel,
wherein the barrel extends through a barrel opening in the latch and through the base opening,
wherein the barrel is in engagement with the barrel nut and the barrel nut is operative to hold the base and latch in engagement with the key lock.

5. The apparatus according to claim 3
wherein the case extends outward from a first side of the base,
and further including an adhesive layer that extends on a second side of the base opposed of the first side,
wherein the adhesive layer is operative to engage the latch and hold the base in fixed engagement with the latch.

6. The apparatus according to claim 3
wherein the plate is rotatable about the cylinder axis,
wherein the plate includes at least one radially outward extending plate projection,
wherein the at least one plate projection is operative to limit rotational movement of the plate by engagement of the at least one plate projection and the case.

7. The apparatus according to claim 3
wherein the plate includes an arcuate edge, wherein the arcuate gear segment is integral with the arcuate edge.

8. The apparatus according to claim 3
and further including a cap,
wherein the cap is operatively engaged with the lock cylinder and is rotatable therewith,
wherein the cap includes
an annular radially extending face surface in relatively movable abutting relation with the plate,
a central cylindrical ring extending axially outward from the face surface,
wherein the projection extends radially outward from the cylindrical ring and wherein the slot is bounded radially inwardly by the cylindrical ring.

9. The apparatus according to claim 8
wherein the cap includes an axially central cap opening therethrough,
a cap fastener, wherein the cap fastener extends through the cap and is operative to hold the cap in relatively fixed operative engagement with the lock cylinder, and
wherein the plate is in relatively movable rotational engagement with the cap.

10. The apparatus according to claim 8
wherein the cap includes two diametrically opposed projections,
wherein the plate includes two opposed arcuate slots,
wherein the plate is configured so that both projections are in simultaneous engagement with both the first end surfaces or the second end surfaces bounding the slots.

11. The apparatus according to claim 8
wherein the lock cylinder is rotatable through an angle of at least 90° without causing movement of the plate.

12. The apparatus according to claim 8
wherein the latch condition lever is in operative connection with a pin,
wherein the pin extends in movable relation in a lever slot,
wherein movement of the latch condition lever between the first condition lever position and the second condition lever position is operative to move the pin relative to the lever slot.

13. The apparatus according to claim 12
wherein the lever slot extends in an actuation lever, wherein the actuation lever is rotatable about a pivot axis,
and further including a disconnect lever, wherein movement of the handle is operative to cause movement of the disconnect lever,
wherein the disconnect lever includes a further lever slot, and is rotatable about the pivot axis, and wherein the pin extends in movable relation in the further lever slot,
wherein in the first condition lever position the pin is operative to cause the disconnect lever and the actuation lever to rotate together about the pivot axis, wherein rotation of the actuation lever is operative to cause the latch to change from the latched condition to the unlatched condition,
and wherein in the second condition lever position rotation of the disconnect lever about the pivot axis does not cause movement of the actuation lever about the pivot axis.

14. The apparatus according to claim 13 and further including
a latch housing, wherein the handle is rotatable relative to the latch housing,
wherein the handle is manually engageable on a first side of the latch housing,
wherein the handle is in operative connection with a trigger,
wherein the trigger extends through the latch housing to a second side of the latch housing,
wherein the trigger operatively movably engages the disconnect lever on the second side of the latch housing.

15. The apparatus according to claim 13 and further including
the latch, wherein the latch includes a rotatable catch jaw and a rotatable release pawl,
wherein the catch jaw is rotatable between a latched jaw position wherein the jaw is engaged with a post, and unlatched jaw position wherein the jaw is disengageable from the post,
wherein the release pawl is rotatable between an engaged position and a disengaged position,
wherein in the engaged position the release pawl is operative to engage the catch jaw and hold the catch jaw in the latched jaw position, wherein in the disengaged position the release pawl is operative to allow the catch jaw to move from the latched jaw position to the unlatched jaw position wherein the post and the jaw can disengage, wherein movement of the actuation lever about the pivot axis is operative to cause the release pawl to move from the engaged position to the disengaged position.

16. The apparatus according to claim 15 wherein the release pawl includes a step, wherein the actuation lever includes a projection, wherein the actuation lever is operative to move the release pawl between the engaged position and the disengaged position by engaged movement of the projection and the step.

17. The apparatus according to claim 16 wherein the case has a releasable cover, wherein the releasable cover bounds the case slot and prevents disengagement of the arcuate gear segment and the pinion, wherein the cover is held in engagement with the case through at least one releasable cover fastener, wherein the cover includes at least one inward extending cover projection, wherein the at least one inward extending cover projection is in operative connection with the motor, wherein the at least one inward extending cover projection holds the motor within the case.

18. Apparatus comprising:

an actuator configured for use with a latch, wherein the latch includes a movable latch condition lever, wherein the latch condition lever is movable between a first condition lever position and a second condition lever position, wherein the latch includes a manually movable handle, wherein when the latch condition lever is in the first condition lever position, movement of the handle is operative to cause the latch to change from a latched condition to an unlatched condition, wherein when the latch condition lever is in the second condition lever position, movement of the handle does not cause the latch to change from the latched condition to the unlatched condition, wherein the actuator includes a key lock, wherein the key lock includes a rotatable lock cylinder, wherein the lock cylinder is rotatable about a cylinder axis, wherein the lock cylinder is held immovable in a first rotational cylinder position when a proper key is not in operative engagement with the key lock, wherein the lock cylinder is rotationally movable from the first rotational cylinder position in a first rotational direction and in an opposed second rotational direction when the proper key is in operative engagement with the key lock, a projection, wherein the projection extends radially outward relative to the cylinder axis and is in fixed operative connection with the lock cylinder, a movable plate, wherein the plate includes an arcuate slot, wherein the arcuate slot is bounded at opposed ends of the slot by first and second radially extending end surfaces, wherein the projection extends in the slot and is movable therein between the first and second end surfaces without causing plate movement, and wherein the plate is movable by the projection through engagement of the projection and each of the first and second end surfaces, wherein the plate is in operative connection with the latch condition lever, an arcuate gear segment, wherein the gear segment is in fixed operative connection with the plate, a motor, a rotatable pinion in operative connection with the motor, wherein the pinion is in operatively engaged connection with the arcuate gear segment, wherein with the proper key in engagement with the key lock responsive to rotation of the lock cylinder in the first rotational direction from the first rotational cylinder position, the projection is operative to move in the arcuate slot and engage the first end surface of the slot to cause plate movement and the latch condition lever to move from the second condition lever position to the first condition lever position, responsive to rotation of the lock cylinder in the second rotational direction opposed of the first rotational direction from the first rotational cylinder position, the projection is operative to move in the arcuate slot and engage the second end surface of the slot opposed of the first end surface, to cause plate movement and the latch condition lever to move from the first condition lever position to the second condition lever position, and wherein with the proper key not in engagement with the key lock and the lock cylinder held immovable in the first rotational cylinder position, motor rotation in a first rotational motor direction is operative to cause plate movement with the projection positioned in the arcuate slot between the first and second end surfaces, and the latch condition lever to move from the second condition lever position to the first condition lever position, motor rotation in a second rotational motor direction opposed of the first rotational motor direction, is operative to cause plate movement with the projection positioned in the arcuate slot between the first and second end surfaces, and the latch condition lever to move from the first condition lever position to the second condition lever position.

19. Apparatus comprising a latch, wherein the latch includes a rotatable catch jaw, wherein the catch jaw is rotatable between a latched jaw position wherein the jaw is engaged with a post, and an unlatched jaw position wherein the jaw is disengageable from the post, a rotatable release pawl, wherein the release pawl is rotatable between an engaged position in which the release pawl engages the catch jaw and holds the catch jaw in the latched jaw position, and a disengaged position, wherein in the disengaged position the release pawl enables the catch jaw to move from the latched jaw position to the unlatched jaw position, a manually movable handle, a lock, wherein the lock includes a rotatable key cylinder, wherein the key cylinder is rotatable by a proper key in engagement therewith and is held rotationally immobile when the proper key is not in engagement therewith, wherein the key cylinder is in fixed operative connection with a radially extending projection, a motor, a movable plate, wherein the movable plate includes a slot, wherein the radially extending projection extends in the slot and is relatively movable therein, wherein the movable plate is in operative movable connection with both the motor and the key cylinder, wherein the movable plate is movable between a connected position and a disconnected position, wherein with the plate in the connected position, manual movement of the handle is operative to cause the release pawl to move from the engaged position to the disengaged position, and wherein with the plate in the disconnected position, manual movement of the handle is not operative to cause the release pawl to move from the engaged position to the disengaged position, wherein the motor and the key cylinder are each operative to independently move the plate between the connected position and the disconnected position, and wherein with the key cylinder held rotationally immobile, the motor is operative to move the plate between the connected position and the disconnected position while the slot moves and the projection is held stationary therein.

20. The apparatus according to claim 19 wherein the slot is bounded by two radially extending end surfaces, wherein each end surface is at a respective end of the slot, and further including a gear segment, wherein the gear segment is in operative connection with the plate and the motor, a latch condition lever, wherein the latch condition lever is in operative connection with the plate, wherein the latch condition lever is movable between a first condition lever position, and a second condition lever position, wherein the latch condition lever is caused to be in the first condition lever position when the plate is in the connected position, and caused to be in the second condition lever position, when the plate is in the disconnected position, wherein in the first condition lever position the latch condition lever is operative responsive to handle movement to cause movement of the release pawl, and wherein in the second condition lever position the latch condition lever is operative not to cause movement of the release pawl responsive to handle movement, wherein with the motor not operative to move the plate, the plate is movable between the connected position and the disconnected position responsive to rotational movement of the key cylinder and engaged movement of the projection and at least one of the end surfaces of the slot.

21. The apparatus according to claim 19 wherein the slot is bounded by two transverse end surfaces at opposed ends of the slot, and further including a gear segment, wherein the gear segment is in operative connection with the plate and the motor, a latch condition lever, wherein the latch condition lever is in operative connection with the plate, wherein the latch condition lever is movable between a first condition lever position and a second condition lever position, wherein the latch condition lever is in the first condition lever position when the plate is in the connected position, and in the second condition lever position when the plate is in the disconnected position, wherein in the first condition lever position the latch condition lever is operative responsive to handle movement to cause movement of the release pawl, and wherein in the second condition lever position the latch condition lever is operative not to cause movement of the release pawl responsive to handle movement, wherein with the motor not operative to move the plate, the plate is movable between the connected position and the disconnected position responsive to rotational movement of the key cylinder and engaged movement of the projection and at least one of the end surfaces of the slot.

22. Apparatus comprising:

an actuator configured for use with a latch, wherein the latch includes a movable latch condition lever, wherein the latch condition lever is movable between a first condition lever position and a second condition lever position, wherein the latch includes a manually movable handle, wherein when the latch condition lever is in the first condition lever position, movement of the handle is operative to cause the latch to change from a latched condition to an unlatched condition, and wherein when the latch condition lever is in the second condition lever position, movement of the handle does not cause the latch to change from the latched condition to the unlatched condition, wherein the actuator includes a key lock, wherein the key lock includes a rotatable lock cylinder, wherein the lock cylinder is rotatable about a cylinder axis, wherein the lock cylinder is held rotationally immovable in a first rotational cylinder position when a proper key is not in operative engagement with the key lock, and wherein the lock cylinder is rotationally movable from the first rotational cylinder position in a first rotational direction and in an opposed second rotational direction when the proper key is in operative engagement with the key lock, a projection, wherein the projection extends radially outward relative to the cylinder axis and is in fixed operative connection with the lock cylinder, a movable plate, wherein the plate is in operative connection with the latch condition lever, wherein the plate includes an arcuate slot, wherein the arcuate slot is bounded at respective opposed ends of the slot by first and second radially extending end surfaces, wherein the projection extends in the slot and is movable therein between the first and second end surfaces without causing plate movement, and wherein the plate is movable by the projection through engagement of the projection and each of the first and second end surfaces, an arcuate gear segment, wherein the gear segment is in fixed operative connection with the plate, a motor, a rotatable pinion in operative connection with the motor, wherein the pinion is in operatively engaged connection with the arcuate gear segment, wherein with the proper key in engagement with the key lock, responsive to rotation of the lock cylinder in the first rotational direction from the first rotational cylinder position, the projection is operative to move in the arcuate slot and engage the first end surface of the slot to cause plate movement and the latch condition lever to move from the second condition lever position to the first condition lever position, and responsive to rotation of the lock cylinder in the second rotational direction opposed of the first rotational direction from the first rotational cylinder position, the projection is operative to move in the arcuate slot and engage the second end surface of the slot opposed of the first end surface to cause plate movement and the latch condition lever to move from the first condition lever position to the second condition lever position, and wherein with the proper key not in operative engagement with the key lock and the lock cylinder held rotationally immovable in the first rotational cylinder position, motor rotation in a first rotational motor direction is operative to cause plate movement while the projection is held in a rotationally immovable position in the arcuate slot intermediate of the first and second end surfaces, and the latch condition lever to move from the second condition lever position to the first condition lever position, and motor rotation in a second rotational motor direction opposed of the first rotational motor direction, is operative to cause plate movement while the projection is held in the rotationally immovable position in the arcuate slot intermediate of the first and second end surfaces, and the latch condition lever to move from the first condition lever position to the second condition lever position.

23. The apparatus according to claim 22 wherein the motor and the pinion are housed in a case, wherein the case includes a case slot, wherein the arcuate gear segment extends in the case slot and engages the pinion within the case.

* * * * *